US008915805B2

(12) United States Patent
Santini et al.

(10) Patent No.: US 8,915,805 B2
(45) Date of Patent: Dec. 23, 2014

(54) EXTENDED PLAYING SURFACE APPARATUS FOR TABLE TENNIS

(71) Applicants: Marco Santini, Cresskill, NJ (US); Daniel Kearney, Mahwah, NJ (US)

(72) Inventors: Marco Santini, Cresskill, NJ (US); Daniel Kearney, Mahwah, NJ (US)

(73) Assignee: Mind Slam LLC, New York, NY (US)

( * ) Notice: Subject to any disclaimer, the term of this patent is extended or adjusted under 35 U.S.C. 154(b) by 34 days.

(21) Appl. No.: 13/768,034

(22) Filed: Feb. 15, 2013

(65) Prior Publication Data

US 2013/0217521 A1 Aug. 22, 2013

Related U.S. Application Data

(60) Provisional application No. 61/600,597, filed on Feb. 18, 2012.

(51) Int. Cl.

| | |
|---|---|
| ***A63B 67/04*** | (2006.01) |
| ***A63B 69/00*** | (2006.01) |
| ***A47B 25/00*** | (2006.01) |

(52) U.S. Cl.

CPC ..... *A63B 67/04* (2013.01); *A63B 69/0097* (2013.01); *A47B 25/003* (2013.01); *A63B 2207/02* (2013.01)

USPC ..... 473/496; 473/475

(58) Field of Classification Search

USPC ..... 473/496, 524, 526, 527, 549, 551, 552

See application file for complete search history.

(56) References Cited

U.S. PATENT DOCUMENTS

| | | | | |
|---|---|---|---|---|
| 2,174,884 | A * | 10/1939 | Kachel | 473/434 |
| 2,313,701 | A * | 3/1943 | White | 473/475 |
| 4,030,734 | A | 6/1977 | Castellucci | |
| 4,772,018 | A * | 9/1988 | Inniger | 473/475 |
| 4,969,645 | A * | 11/1990 | Barbador | 473/475 |
| 5,178,385 | A * | 1/1993 | Barbador | 473/475 |
| 5,460,365 | A * | 10/1995 | Payne | 473/494 |
| 5,575,471 | A | 11/1996 | Robinson | |
| 5,833,559 | A * | 11/1998 | Appelbaum et al. | 473/496 |
| 6,939,256 | B2 | 9/2005 | Giacomoni et al. | |
| 7,597,558 | B2 * | 10/2009 | Mazloompour | 434/247 |
| 2004/0067796 | A1 * | 4/2004 | Murrey et al. | 473/4 |
| 2004/0164488 | A1 * | 8/2004 | Fitzgerald | 273/108.1 |
| 2011/0172037 | A1 * | 7/2011 | Seme | 473/475 |

* cited by examiner

*Primary Examiner* — Nini Legesse

(57) ABSTRACT

The object of the present invention is to provide an extended playing surface for paddle/racquet-based games, in particular table tennis. A playing surface is provided comprising four curved rebounding surfaces each with a vertical rebounding side wall configured so that two curved surfaces attach or extend on each side of a substantially horizontal playing surface thereby forming a continuous rebounding playing surface. A net is positioned perpendicular to the length of the horizontal playing surface at its mid point, allowing two or more opposing players to use the curved, vertical sidewall and horizontal surfaces as rebounding surfaces to serve, return and rally a spherical target object over the net.

18 Claims, 27 Drawing Sheets

EXTENDED PLAYING SURFACE APPARATUS FOR TABLE TENNIS

BACKGROUND OF THE INVENTION

The field of this invention relates to table tennis or ping pong and variations of the game thereof. Currently, table tennis is played on a flat rectangular surface. The official dimensions of a table tennis table are a flat rectangular table positioned 2 feet 6-inches above the ground, with a 5-foot width, 9-foot length, a 6-inch net positioned midway between the length of the table having a 6-inch overhang on each side. The International Table Tennis Federation "ITTF" and the USA Table Tennis organization maintain the official rules of Table Tennis. The official USA Table Tennis rules are hereby incorporated by reference herein. The official USA Table Tennis rules are publicly distributed at http://www.teamusa.org/USA-Table-Tennis/Rules.aspx and at the time of this writing were last updated Sep. 1, 2010.

There has been very limited innovation in the standard game of table tennis, and in particular, the surface on which the game itself is played. The object of the present invention is to enhance the playing surface of the standard table tennis game or any paddle based game in general requiring a flat horizontal surface by creating a vertical dimension to an otherwise 2-D horizontal game.

SUMMARY OF THE INVENTION

The present disclosure describes a table tennis apparatus for extending a table tennis playing surface. The disclosed apparatus comprises a concave curved section having a predetermined length, a predetermined thickness, a central axis, a first edge and a second edge both perpendicular to said central axis, a third edge and a fourth edge equal to said predetermined length and both parallel to said central axis, a first surface on the interior of said concave curved section and a second surface on the exterior of said concave curved section. Said third edge of the curved section is configured to attach to a side edge of a flat horizontal playing surface, in particular, a table tennis playing surface and said first surface of the curved section is configured to extend a horizontal table tennis playing surface. In a preferred embodiment, the curved section is made from a transparent material having rebounding properties similar to that of the horizontal playing surface to which it is attached.

The mathematical description of the curved section of the table tennis apparatus can be arrived at through multiple ways and is not limited to the disclosures herein. For the purposes of this disclosure, the concave curve section can be described as a section of an elliptical cylinder described under a Cartesian coordinate system. The curved section having an arc equal to an elliptical arc formed from a section of an ellipse having a pre-determined first radius "a" and a pre-determined second radius "b". Said first radius and said second radius can be equal or different and an angle formed by the start of said elliptical arc, an origin of said ellipse and an end of said elliptical arc equals an angle formed by said third edge, said central axis and said fourth edge of said curved section.

The table tennis apparatus may further comprise a rebounding side wall comprising, a joining edge configured to attach to said fourth edge of said curved section, a rebounding surface configured to extend said first surface of said curved section and an exterior surface configured to extend said second surface of said curved section. The surfaces of said horizontal section, curved section and sidewall can be transparent, translucent or opaque, or any combination thereof.

The present disclosure further comprises a method for extending a table tennis playing surface comprising the steps of (i) forming a curved playing surface section comprising a predetermined length, a predetermined thickness, a central axis, a first edge and a second edge both perpendicular to said central axis, a third edge and a fourth edge equal to said predetermined length, and both parallel to said central axis, a first surface on the interior of said concave curved section, a second surface on the exterior of said concave curved section, said third edge being configured to attach to a side edge of said standard table tennis playing surface, and said first surface being configured to extend said table tennis playing surface and (ii) attaching said curved playing surface section to a side of a table tennis playing surface. The method can further comprise attaching a rebounding side wall to a fourth edge of said curved playing surface, said side wall comprising an edge configured to attach to said fourth edge of said curved section, a rebounding surface configured to extend said first surface of said curved section, and an exterior surface configured to extend said second surface of said curved section.

The present disclosure further describes a table tennis playing surface apparatus comprising a horizontal section comprising a first playing surface, a first and a second side edge equal to a length of the horizontal section, and a front edge and a back edge equal to a width of the horizontal section. A curved section comprising a second playing surface, a first and second side edge equal to a length of said curved section, a front edge and a back edge are connected at either the first or second side edge of the curved section to the first or second side edge of said horizontal playing surface thereby combining said first and second playing surfaces. A flat planar side wall section comprising a third playing surface, a first and a second side edge equal to the length of said curved section, a front and a back edge, can be connected to an unconnected side edge of said curved playing surface. In a preferred embodiment, the curved section and planar side wall section are molded from the same material and accordingly the connection between an edge of the curved section and an edge of the side wall section is merely an illustrative way to describe the mathematical boundary between the end of the curved section and the flat planar section.

The curved section is shaped as a section of an ellipse of radius "a" and radius "b". Radius "a" and said radius "b" can be identical or different depending on the arc of the desired curved section. Again, one or more of the horizontal section, the curved section and the planar section can be transparent, translucent or opaque, and any combination thereof. The rebounding properties of said horizontal playing surface, curved playing surface and planar playing surface extension can be substantially the same in order to keep game play and ball bounce consistent. Alternatively, the rebounding properties of said horizontal playing surface, curved playing surface and planar playing surface extension can be made to be different from each other in order to create a more exciting game play environment.

The length of the curved section can be selected to be less than, greater than or equal to the length of the horizontal playing surface. In a preferred embodiment, the length of the curved section is less than the length of the horizontal playing surface. Also, in a preferred embodiment, the horizontal playing surface, curved playing surface and planar playing surface extensions form a continuous smooth playing surface. The curved section may comprise a slit of sufficient size through which a table tennis net can positioned. If necessary, said planar playing surface extension comprises a slit configured to extend said slit in the curved section.

An embodiment of the table tennis extending apparatus is a concave curved section comprising a rebounding surface configured to attach to a side edge of a table tennis playing surface. The connection between the table tennis playing surface and the concave curved section in a preferred embodiment is smooth thereby providing an extended continuous rebounding playing surface. The table tennis playing surface and curved section may be of the same material, that is to say, a single piece of material or the curved section may comprise a separate piece of material being attached to the table tennis playing surface. A flat sidewall planar section is configured to attach to an edge of the curved section and extend vertically, thereby creating a continuous playing surface.

It is another object of the present invention to provide an extended table tennis playing surface comprising a horizontal section, a curved section and a sidewall section. In a preferred embodiment, the horizontal section is comparable to a normal table tennis playing surface, a concave section is attached to each side edge of the horizontal section and a side wall is attached to each free edge of the concave section. All the connections between the horizontal sections, curved sections and sidewall sections are smooth and the produced effect is a smooth and continuous playing surface for the game of table tennis. The playing surface provided in a preferred embodiment comprises a substantial horizontal rectangular rebounding playing surface, a curved section attached to each side of the horizontal playing surface and flat rebounding side walls extending from the curved section to provide a continuous smooth playing surface for rebounding a ball. A net is provided midway on the horizontal playing surface perpendicular to the length of the horizontal playing surface. The table tennis playing surface now comprises the horizontal playing surface as well as the curved section and rebounding sidewalls. All surfaces are roughly the same elasticity to provide uniform rebounding properties when struck with a ball during game play; however, the rebounding qualities of each surface can be adjusted in alternative embodiments.

The substantial increase in playing surface area allows for a much greater variety of angled shots, faster and more rapid ball movement in both velocity and direction changes which can create a much more athletically intense, challenging and exciting game. In contrast, the substantial increase in playing surface area could also allow for an easier game, extending the average length of volleys, and allow children and/or unskilled players to keep the ball with the extended playing surface boundaries longer.

The curved section and sidewalls may extend the entire length of the horizontal playing surface or extend along only a section of the length of the horizontal playing surface. The curved section and sidewalls can be formed together with the playing surface to create one smooth structurally continuous surface or alternatively the curved section and sidewalls can be constructed separately and combined to a regular table tennis game via supports. In alternative embodiments the sidewalls can have external support structures extending in both the vertical direction for height, and/or angled supports to prevent the structure from tipping. Alternatively, the sidewalls can stand based solely on the material connection between the horizontal sections with the curved section with the sidewall section.

BRIEF DESCRIPTION OF THE DRAWINGS

Other objects, features and advantages of the present invention will become more apparent from the following detailed description when read in conjunction with the accompanying drawings, in which:

FIGS. 9*c*-9*f* show a slit 901 in a curved section 102 and sidewall 103 as well as numerous light emitting objects 902 embedded in the curved section and sidewall.

DETAILED DESCRIPTION OF EMBODIMENTS

Figure 1:
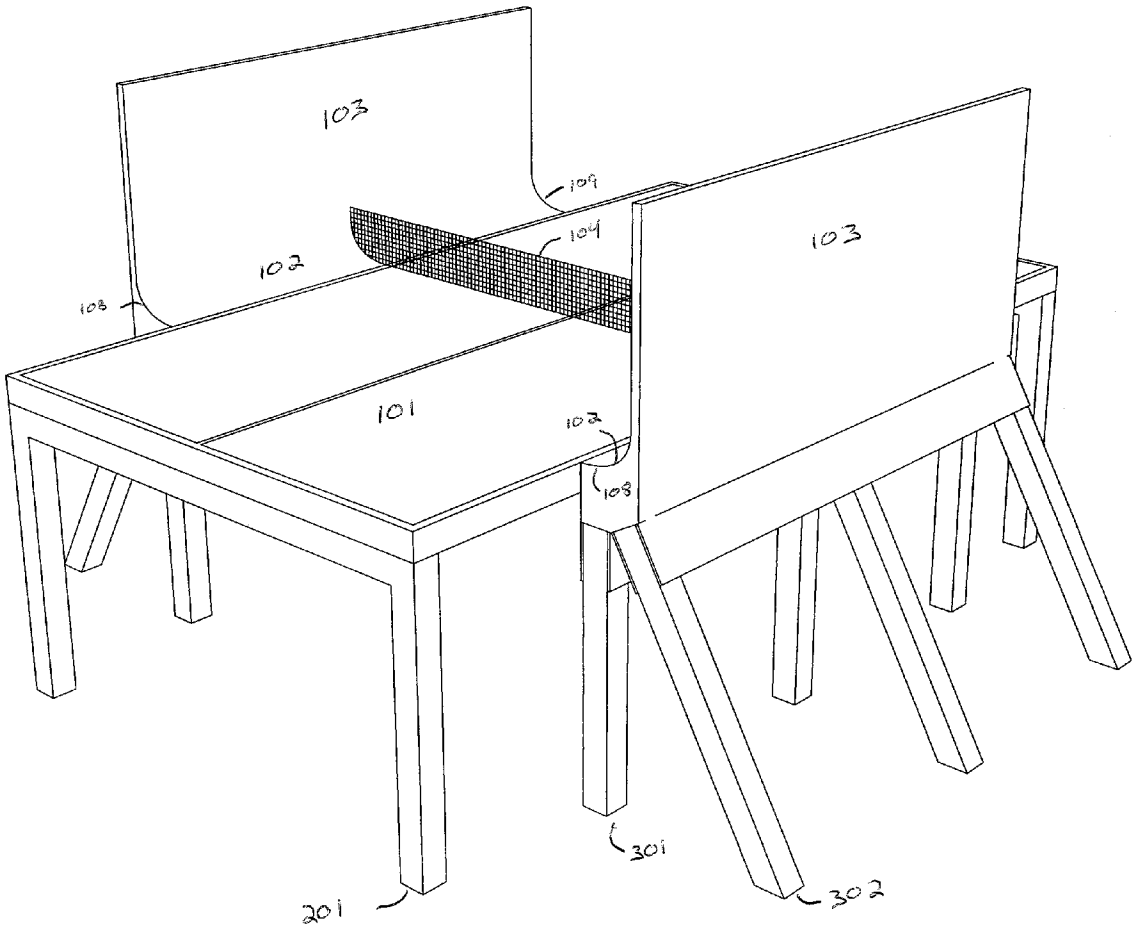
FIG. 1 is a perspective view of a preferred embodiment of the table tennis apparatus.
Figure 2:
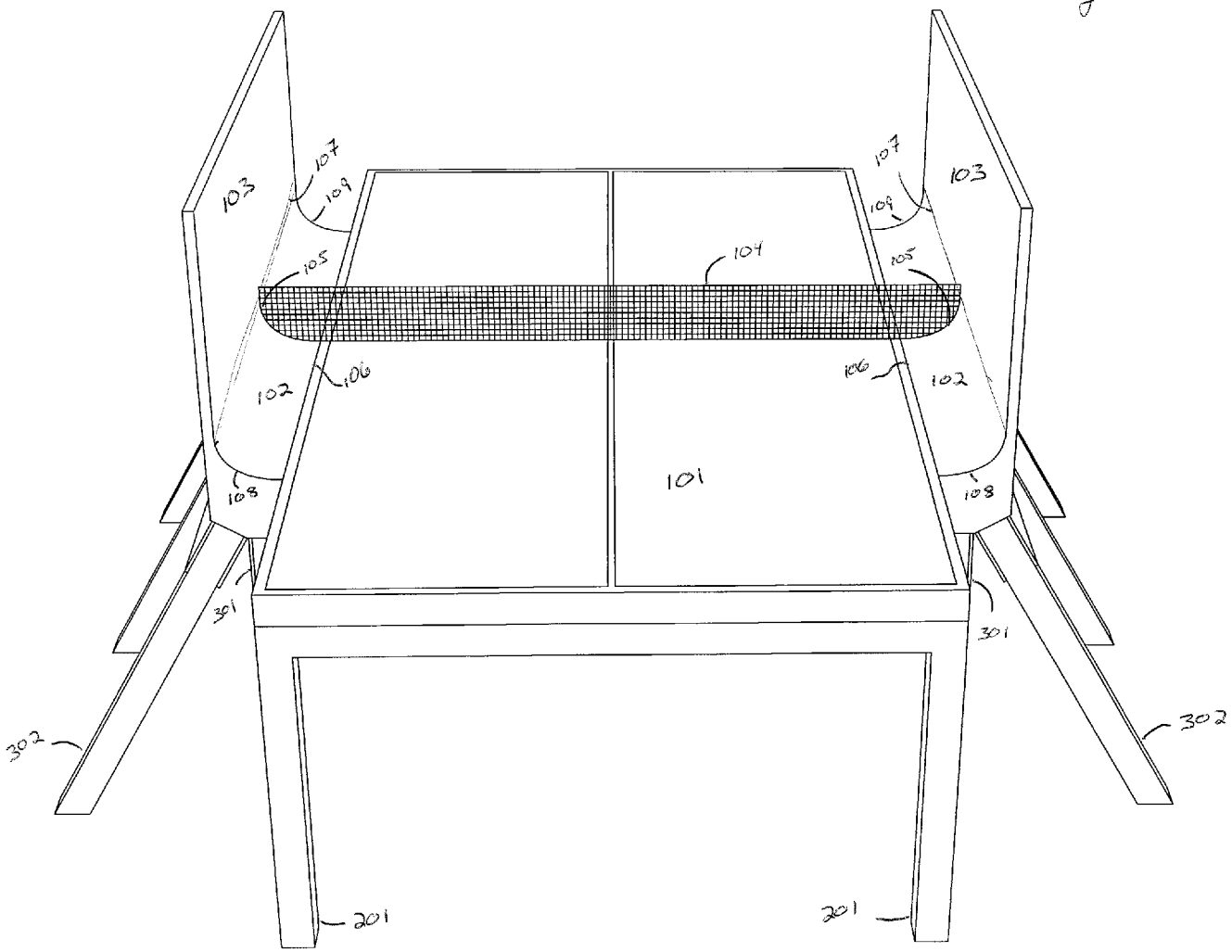
FIG. 2 is a longitudinal view of the table tennis apparatus of FIG. 1.

FIG. 1 shows a perspective of an embodiment of the extended table tennis playing surface apparatus. FIG. 2 shows a longitudinal view of the apparatus shown in FIG. 1. Horizontal section 101 is comparable to a standard table tennis playing surface. Curved sections 102 are provided across from each other on opposite sides of the horizontal section 101. FIGS. 1 and 2 show an embodiment of the curved section 102 for extending the table tennis playing surface 101. Curved section 102 has a predetermined length, in this case a length chosen to be less than the length of the horizontal section 101. The first edge 108 and the second edge 109 of the curved section are both perpendicular to said central axis. The third edge 106 and the fourth edge 107 are equal to said predetermined length, and both parallel to said central axis. The interior surface of said concave curved section is designed to rebound a table tennis ball. A second surface on the exterior of said concave curved section is present. The third edge is configured to attach to a side edge of said standard table tennis playing surface and said first surface is configured to extend the horizontal playing surface.

The third edge 106 illustrates the line of contact between horizontal section 101 and curved sections 102. The surface at the third edge 106 is smooth and forms a continuous uniform transition from the playing surface of horizontal section 101 to curved sections 102. Flat/planar sidewalls 103 have a joining edge 107 provided at the fourth edge 107 to respectively provide extensions of the playing surface of each curved section 102. The transitions at 107 are again smooth and continuous to provide a uniform playing surface extending from the playing surface of horizontal potion 101 through curved sections 102 to sidewalls 103. It is important to note that curved section 102 with an attached side wall extension 103 can be made of a single material and then provided to the horizontal section 101, as is the case in FIGS. 1 and 2. As such, a physical "edge" would not exist since curved section 102 and sidewall 103 would be formed from the same material, and instead fourth edge 107 would merely be an illustrative line signaling the end of the curved section and the beginning of the flat sidewall section 103. Likewise, horizontal section 101 and curved section 102 can also be made of a single material and therefore third edge 106 is not a physical "edge" but merely be an illustrative line signaling the end of the horizontal section 101 and start of the curved section 102.

One skilled in the art can appreciate that alternative embodiments may require abrupt and discontinuous transitions at line of contact 106 and 107, and that the texture of the playing surface and rebounding properties of each of horizontal section 101, curved sections 102 and sidewalls 103 may be altered, changed and different from each other to enhance a player's experience.

A net 104 is provided, as is customary with games associated with the playing surface of horizontal section 101. Net 104 is provided to be midway and perpendicular to the length of horizontal section 101. The net 104 can be attached to the curved sections 102 at points 105. The net 104 can be directly attached mechanically, attached via an adhesive or an opening through curved sections 102 can be provided at 105 so that part of net 104 can be drawn through and secured on the opposite/exterior sides of curved sections 102.

Players at opposite ends of horizontal section 101, facing each other in parallel with curved sections 102 and sidewalls 103 can use the entire extended playing surface of the curved sections 102 and sidewalls 103 to enhance game play. Combinations of shots from horizontal section 101 bouncing to curved sections 102 or sidewalls 103 over the net 104 to the opposite side of horizontal section 101, or a bounce directly from side walls 103 to horizontal section 101 and limitless combinations thereof allow for faster ball movement, longer rallies, more intense reactions and faster reflex responses. Paradoxically this enhanced game of table tennis may become easier and more fun for some younger or unskilled players. Playing off the extend playing surface created by the additions of curved section 102 and sidewalls 102 may increase the average volley time as well as make it easier to keep the ball movement on the playing surface as opposed to the regular game of table tennis. One can also appreciate that instead of a right angle being formed at the third edge 106, the curved section 102 ensures there is always an angled vertical bounce from the playing surface of curved section 102, whereas a fully right angle formed by 2 flat playing surfaces at 106 would produce no bounce at all or a bounce that would not provide enough vertical velocity to allow game play to continue.

In a preferred embodiment, curved sections 102 and sidewalls 103 are the same length as each other, form symmetrical surfaces on each side of horizontal section 101 and do not extend the entire length of horizontal section 101. However, in alternative embodiments the length of curved sections 102 can be different from each other, and different from the lengths of sidewalls 103. In addition, the lengths of the curved sections 102 and sidewalls 103 may be much shorter than, the same, or longer than the length of the horizontal section 101. In the preferred embodiment, the lengths of the curved sections and sidewalls are selected to be less than the entire length of the horizontal section 101 in order to create a corner bouncing space of game play wherein shots, angled at a corner of the horizontal section 101, can send a ball outside of the playing surface area. In particular, the angled shots cause a ball to bounce beyond the width of the horizontal section 101 and laterally behind the sidewalls 103. As a result, these angled shots can only be returned by carefully angling a return volley at the respective far corner of horizontal section 101, but preferably at the playing surfaces of opposite sidewall 103 or opposite curved section 102. Alternatively, a volley can be returned by sending a ball over sidewall 103 and down into the horizontal playing surface on horizontal section 101. The exterior second playing surface of sidewall 103 and exterior second playing surface of curved section 102 partially block all of the above return shots and as a result the difficulty, excitement and fun of the game is increased when the length of said curved sections and sidewalls is selected to be less than the entire length of horizontal section 101.

Description of the geometric structure of the curved sections 102 of the extended playing surface apparatus will now be described. The natural shape of the curved sections 102 is that of an elliptical arc. An ellipse being governed by the Cartesian equation:

$$(x/a)^2+(y/b)^2=1$$

where x and y stand for the x-axis and y-axis respectively of the Cartesian coordinate system. Although there are numerous other mathematical coordinate systems and methods for describing and forming ellipses, the above Cartesian method will be used for exemplary purposes. Other methods may be used to accomplish the same ellipse structure without detracting from the disclosed invention herein.

Figure 3:
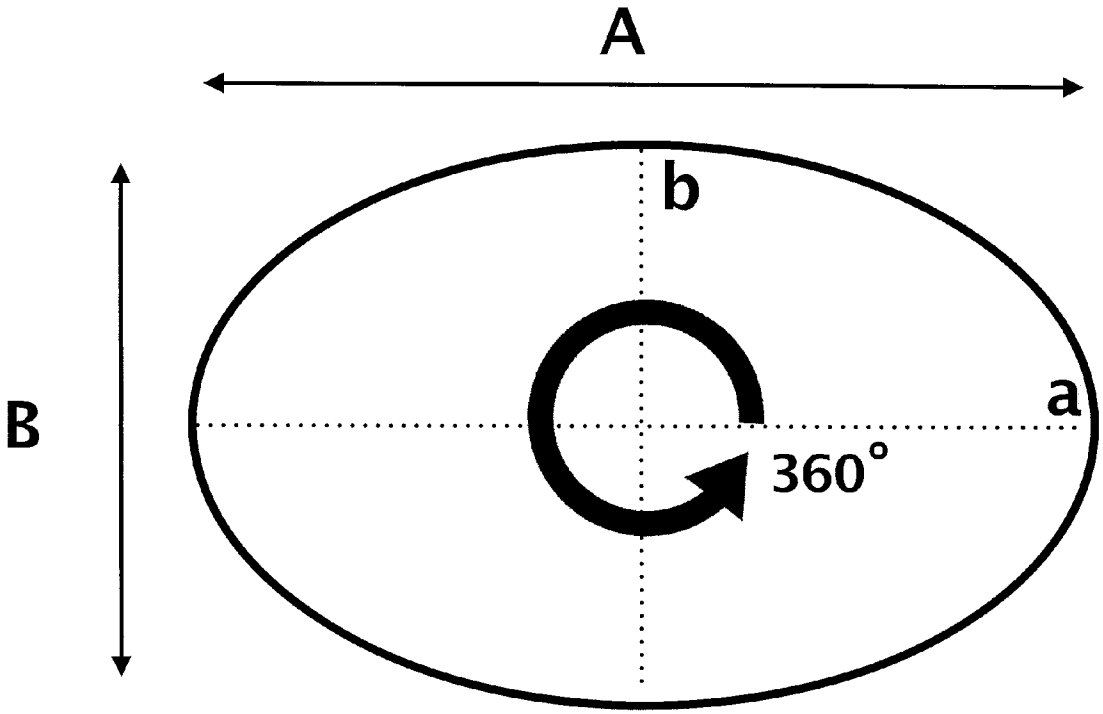
FIG. 3 is an exemplary image of an ellipse with radius "a">radius "b".

In the present invention, let "a" be one of two radii of an ellipse and "b" be the other radii. As shown in FIG. 3, an ellipse is constructed from radius "a" and radius "b", wherein radius "b" corresponds to the y-axis and radius "a" corresponds to the x-axis, the arrow of 360° indicates the counter clockwise direction in which degrees are customarily calculated in coordinate geometry. In coordinate geometry, the degrees are typically calculated starting at the positive x-axis at 0° and rotating left until the x-axis is reached, which encompasses a full 360° rotation.

Figure 4:
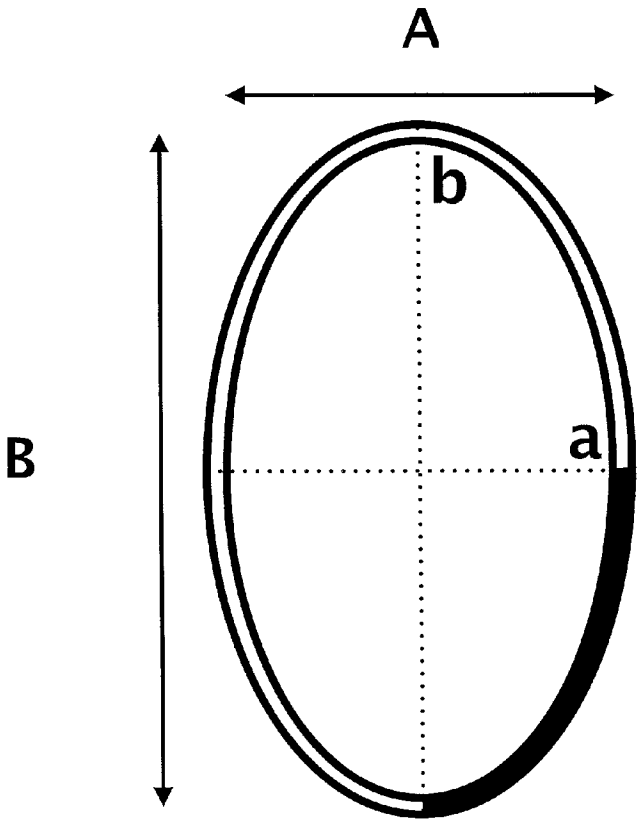
FIG. 4 is an ellipse with radius "a"<radius "b" and shaded region to indicate 270° to 0°.

In the present invention, the size and curvature of a desired curved section of the table extending apparatus can be achieved by appropriately selecting radius "a" and radius "b". Further, after radii "a" and "b" are selected and an ellipse created as defined by the Cartesian equation, a section of that ellipse is selected. From the origin of the ellipse, one can select the section desired by defining a degree range encompassing the desired section. For example, using coordinate geometry wherein the degrees are calculated counter clockwise fashion starting at 0° for the positive x-axis, 90° for the positive y-axis, 180° for the negative x-axis, and 270° for the negative y-axis, we can define the desired section of the ellipse. For example, FIG. 4 is an ellipse with radius "a"<radius "b" and a shaded region to indicate 270° to 0°. In this example, the shaded region is the desired shape of the curved section of the table tennis apparatus, which specifically is a 90° range. It is readily apparent that by appropriately selecting radius "a", radius "b" and a degree range, any desired elliptical arc can be constructed for the curved section of the table tennis apparatus.

Figure 5:
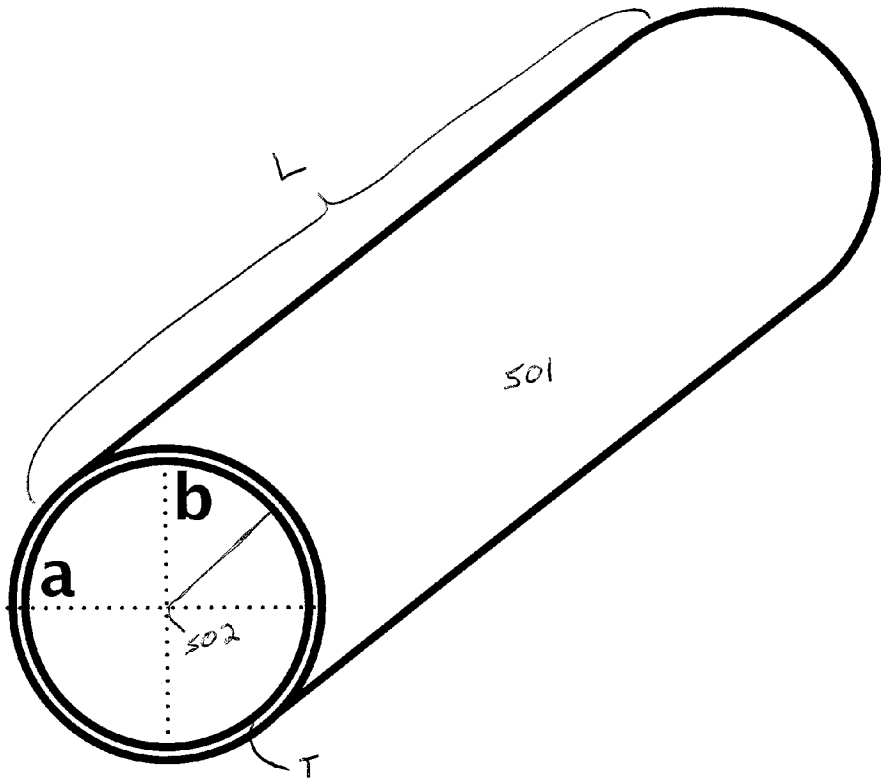
FIG. 5 is a perspective view of a hollow elliptical cylinder with radius "a"=radius "b" for exemplary purposes of showing how the curved sections 102 are structured.

Expanding on this ellipse, if we take the ellipse created by choosing radii "a" and "b" and then use said ellipse as a base for a cylinder with length "L" we now have an elliptical cylinder, as shown in FIG. 5. If we take the desired degree range of a curve of the ellipse as before, we now have a curved playing surface of a desired length which in this case would be the length "L" of the elliptical cylinder.

FIG. 5 is a perspective view of a hollow elliptical cylinder with a central axis 502 for the exemplary showing of how the curved sections 102 of the table tennis apparatus are structured. As can be seen in FIGS. 1 and 2 as well as other Figures, the curved sections 102 are 3-dimensional objects and it naturally follows that the curved sections 102 can be described as sections of an elliptical cylinder. In FIG. 5, the exemplary elliptical cylinder has been selected so that radius "a" is equal to radius "b"; however the disclosed apparatus can also encompass radius "a"< or >radius "b". The hollow cylinder of FIG. 5 shown with perspective has a surface thickness T, length L, horizontal radius "a" and vertical radius "b". Accordingly, the horizontal diameter is 2a=A and the vertical diameter is 2b=B. The material of cylinder 501 is chosen to have the desired rebounding and transparency properties on the inside of the cylinder 501.

Figure 6:
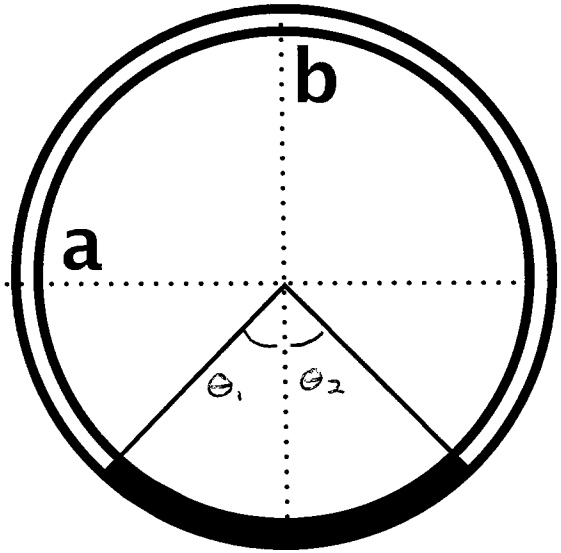
FIG. 6 is a longitudinal view of an exemplary elliptical cylinder with radius "a"=radius "b" and with angles θ1 and θ2 being equal to each other and each less than 90°.

A cross sectional view of cylinder 501 is presented in FIG. 6. After radii "a" and "b" are selected, angles θ1 and θ2 are then chosen and in a preferred embodiment radii "a" and "b" are equal and angles θ1 and θ2 are symmetrical. From the center of the cylinder, angles θ1 and θ2 may comprise any angle from 0° to 360°. FIG. 6 is a longitudinal view of the exemplary cylinder of FIG. 5 with angles θ1 and θ2 both equal to each other and less than 90°. The shaded regions created by angles θ1 and θ2 respectively are the shapes of the elliptical cylinder, which create the curved sections 102 of a table tennis apparatus. In a preferred embodiment, there are two curved sections 102, one for each side of the horizontal section of a table tennis surface and accordingly each shaded region created by angles θ1 and θ2 is a curved section to be placed on opposing sides of the horizontal table tennis surface.

Figure 7:
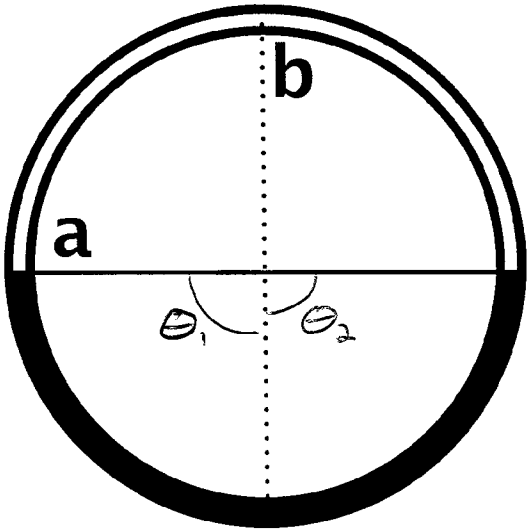
FIG. 7 is longitudinal view of an exemplary elliptical cylinder with radius "a"=radius "b" and with angles θ1 and θ2 each equal to 90°.
Figure 8:
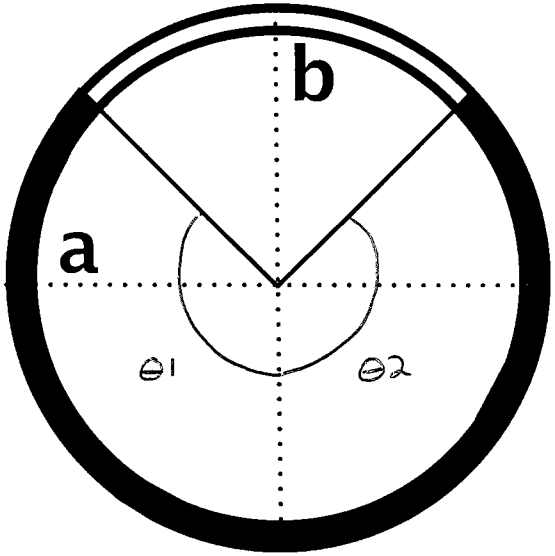
FIG. 8 is longitudinal view of an exemplary cylinder with radius "a"=radius "b" and with angles θ1 and θ2 both equal to each other and each greater than 90°.

Alternatively, FIG. 7 is longitudinal view of the exemplary cylinder of FIG. 5 with angles θ1 and θ2 each equal to 90°, where radius "a"=radius "b" and accordingly each shaded region created by angles θ1 and θ2 are each a curved section to be placed on opposing sides of a horizontal table tennis surface. FIG. 8 is longitudinal view of the exemplary cylinder of FIG. 5 with angles θ1 and θ2 each greater than 90° and radius "a"=radius "b", and accordingly, the shaded regions created by angles θ1 and θ2 are each a curved section to be placed on opposing sides of a horizontal table tennis surface.

FIGS. 1 and 2 show leg support structure 201, 301 and 302. Leg support structure 201 could comprise any vertical support structure to elevate a horizontal surface 101 for table tennis. Leg support structure 301 may comprise one or more vertical supports to elevate the curved section 102 to the same height as that of horizontal surface 101 with the concept that the table tennis surface and curved section form a smooth continuous playing surface. Leg support structures 302 can be provided angled outwards away from the horizontal surface 101 to provide a combination of horizontal and vertical support to curved sections 102 and sidewalls 103. The leg structure 302 in particular could be useful for preventing the curved section 102 and sidewalls 103 from tipping away from the horizontal surface 101, especially if the height of the sidewall 103 becomes large and top heavy. Various combinations of support structures are known in the art of table tennis, which can be used and provided in the extended playing surface apparatus disclosed herein to accomplish sufficient support for the combination of a horizontal surface 101, curved surface 102 and sidewall surface 103.

Figure 9A:
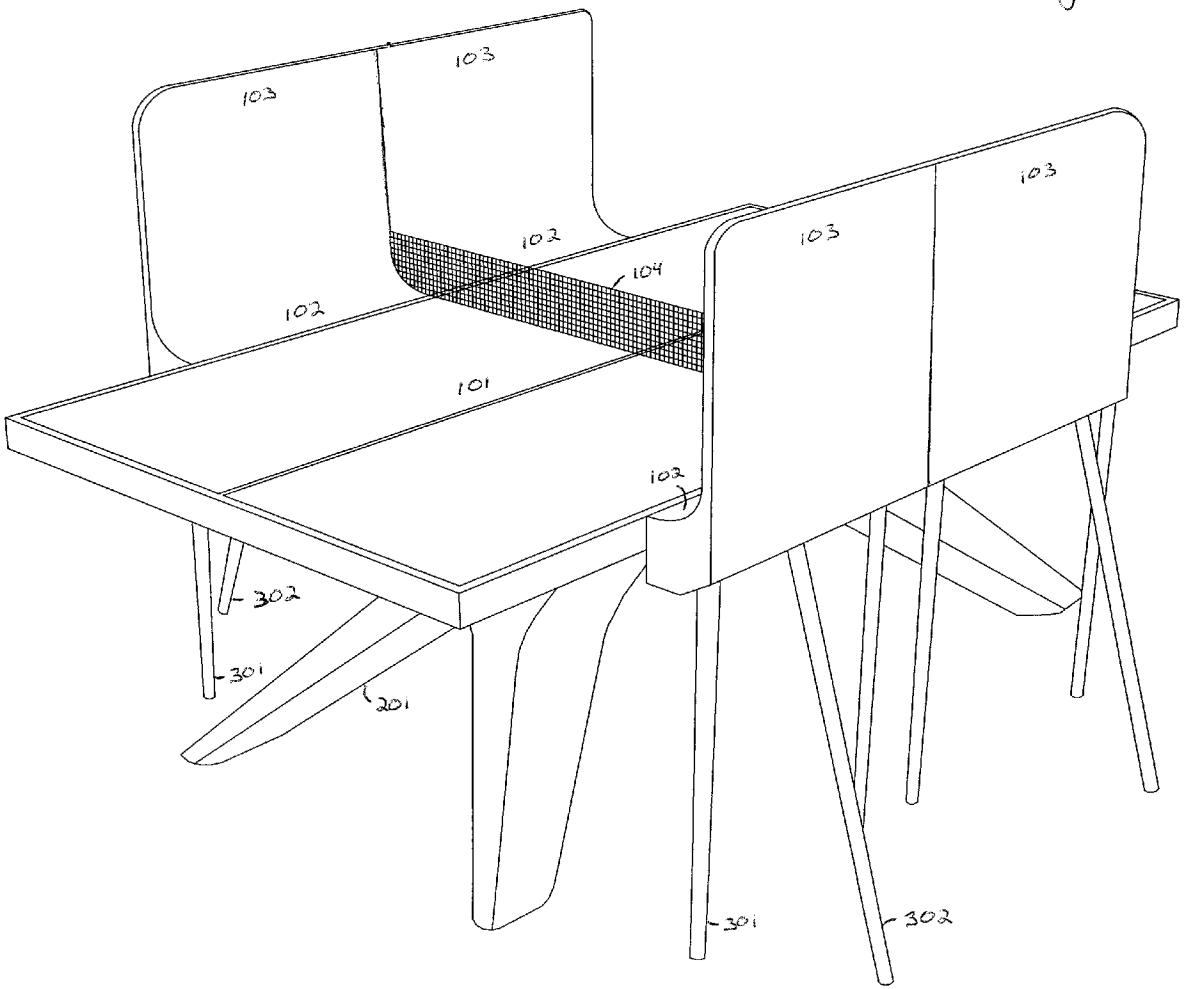
FIGS. 9*a*-9*f* are angled images of a multiple extended playing surface apparatus configuration.
Figure 9B:
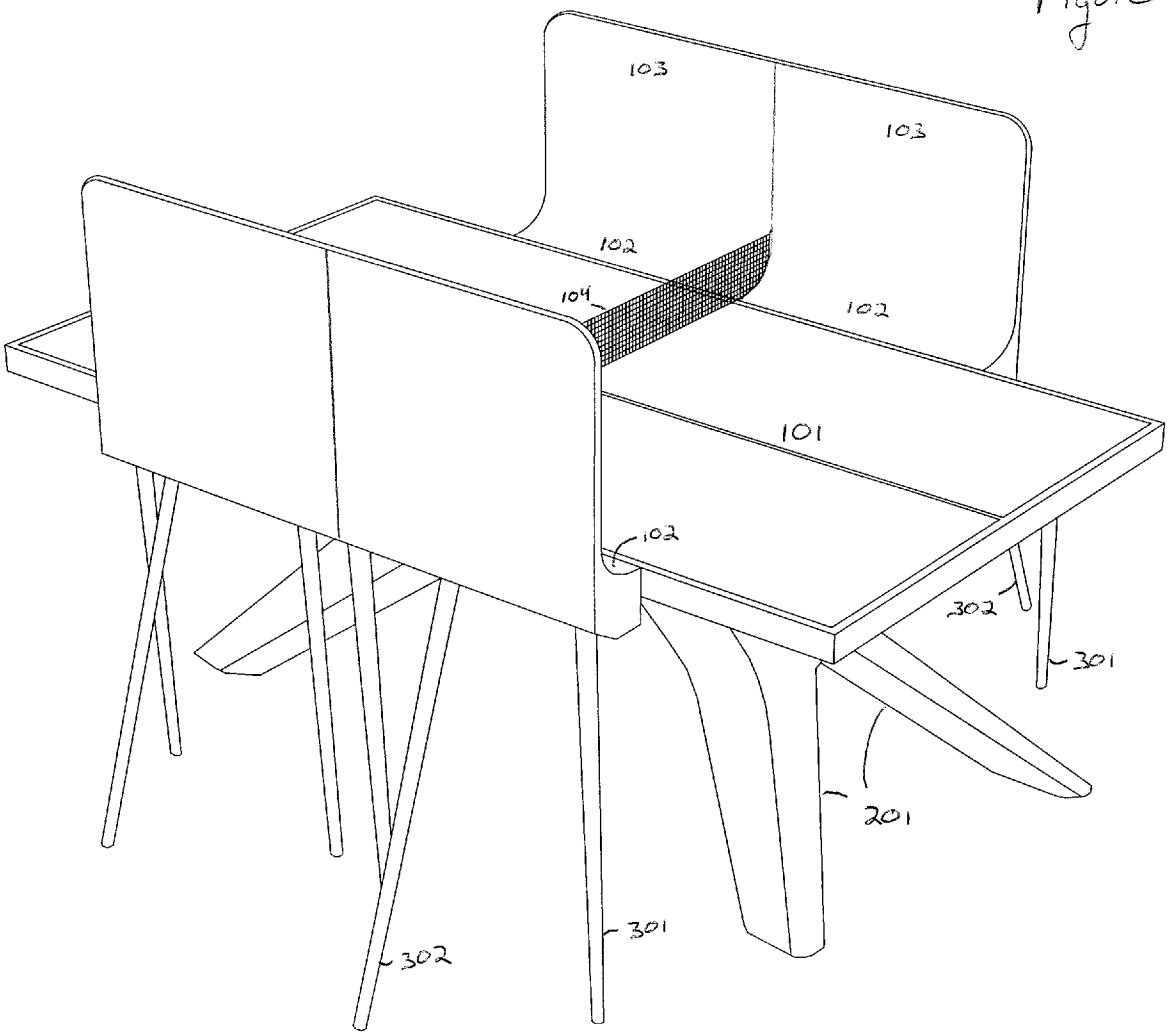
Figure 9C:
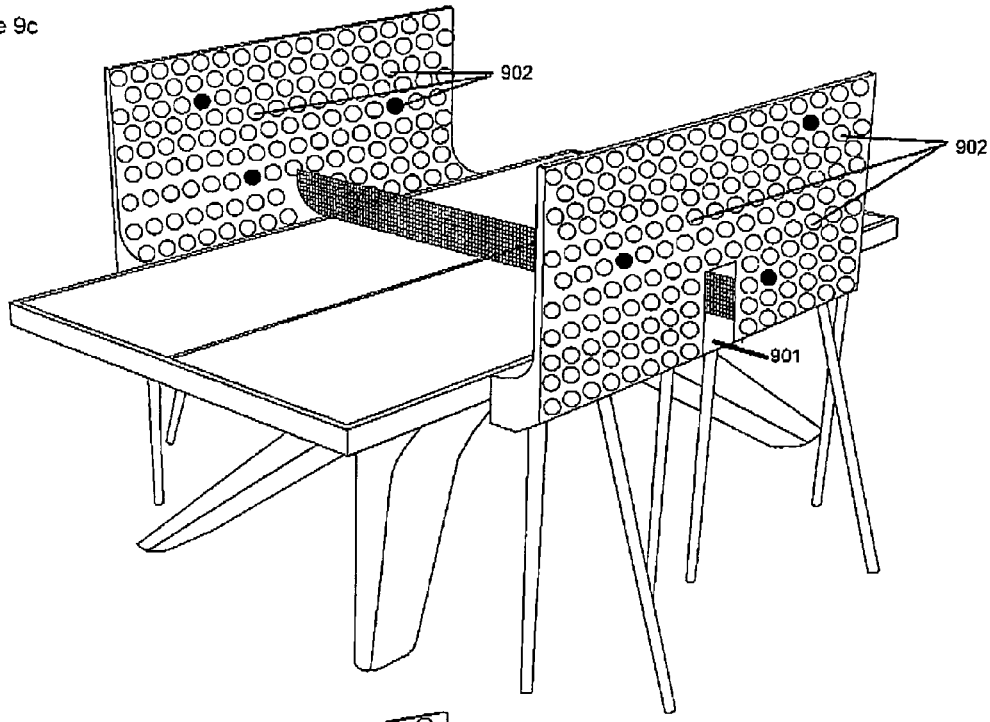
Figure 9D:
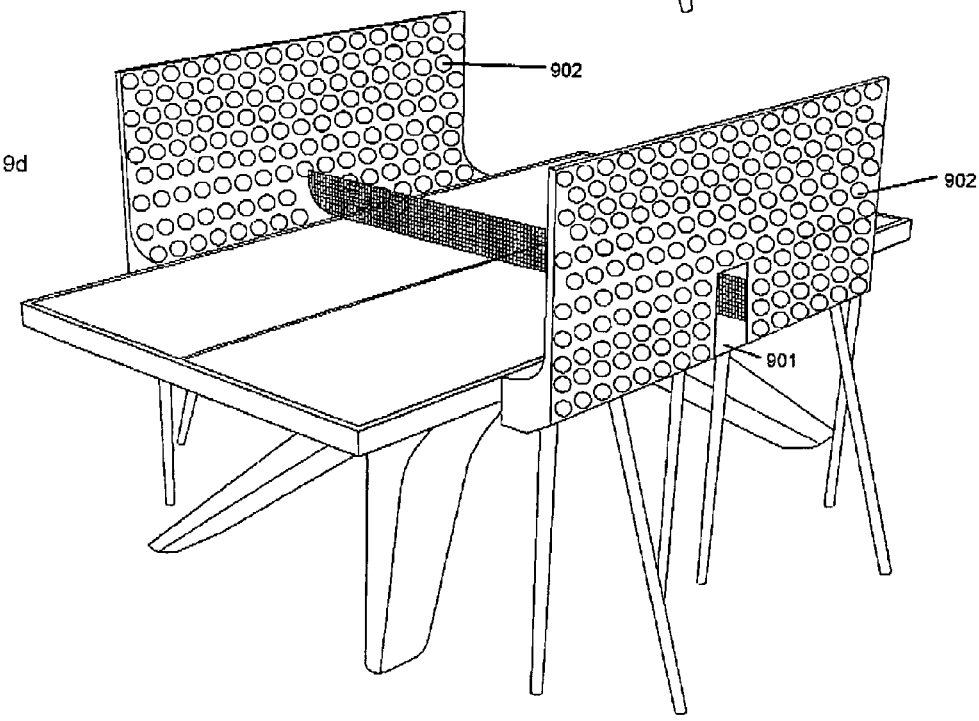
Figure 9E:
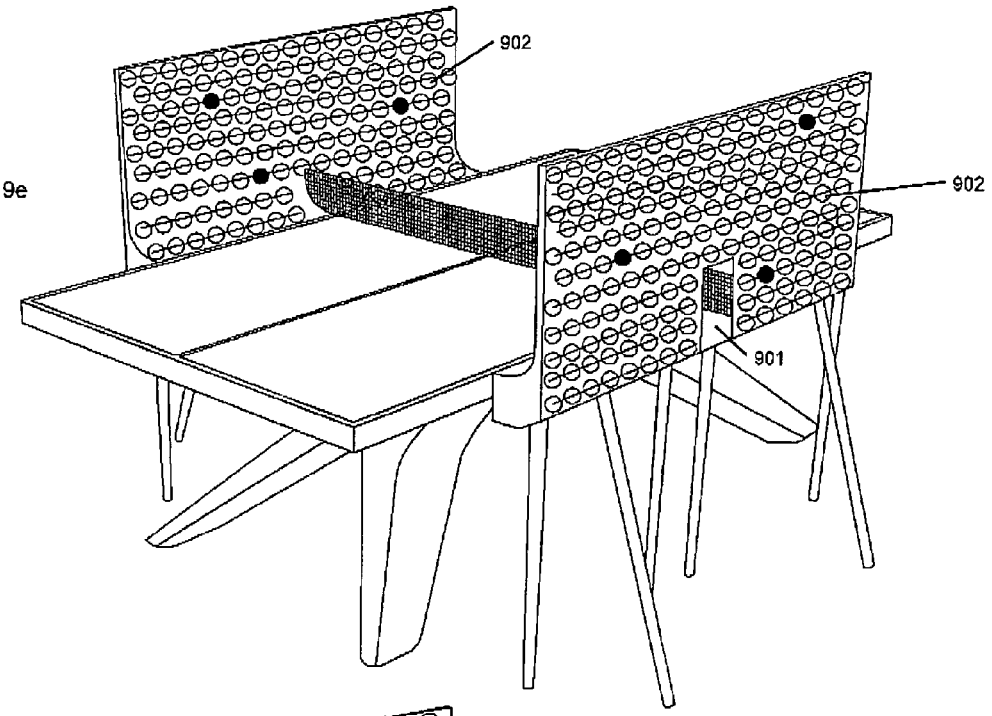
Figure 9F:
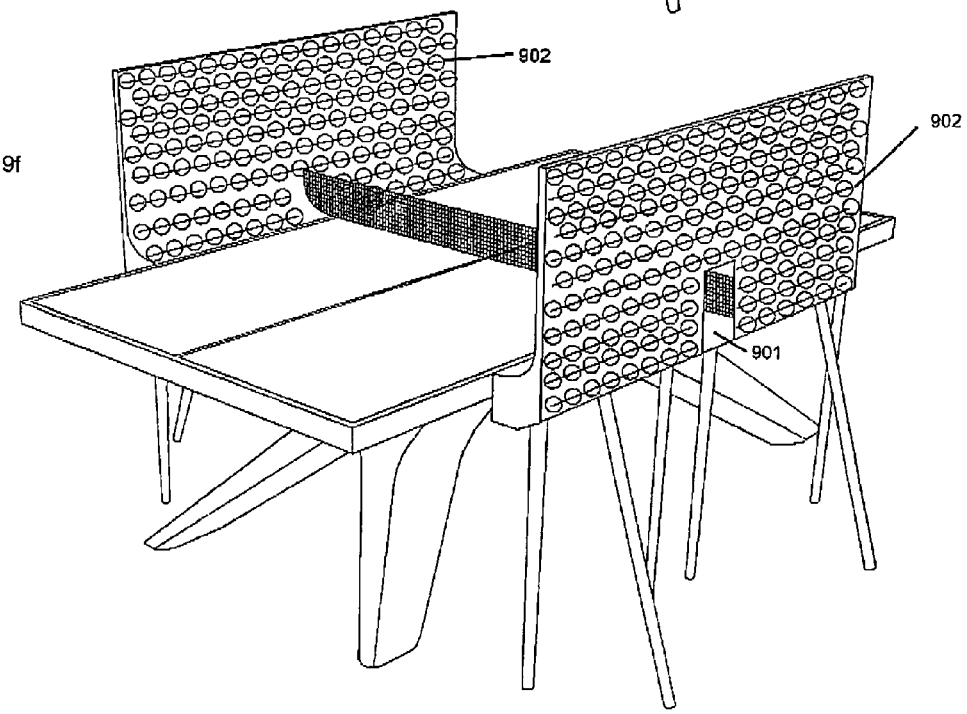
Figure 10:
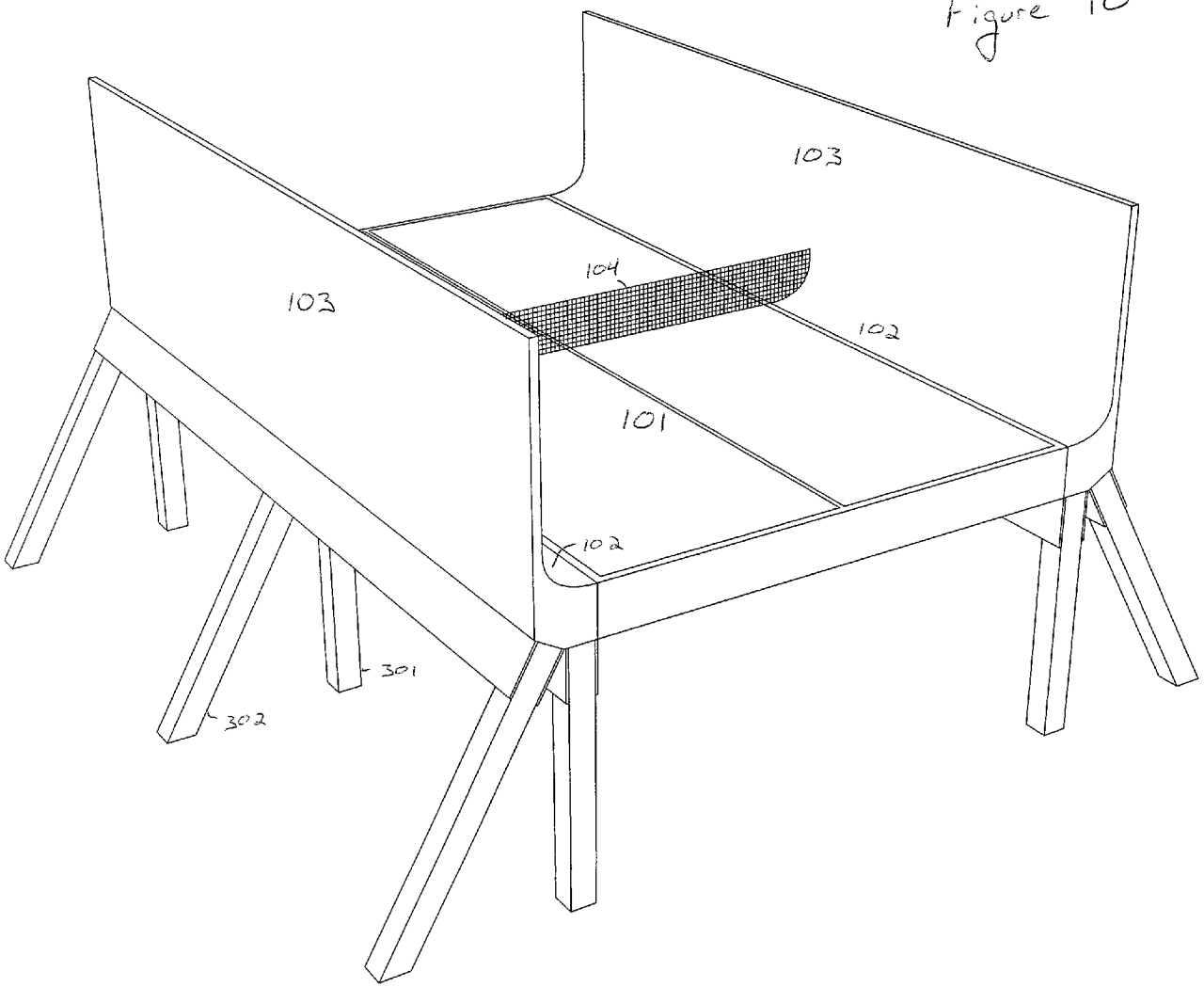
FIG. 10 shows a perspective view of a table tennis apparatus with 90° curved sections of equal length to the horizontal section.
Figure 11:
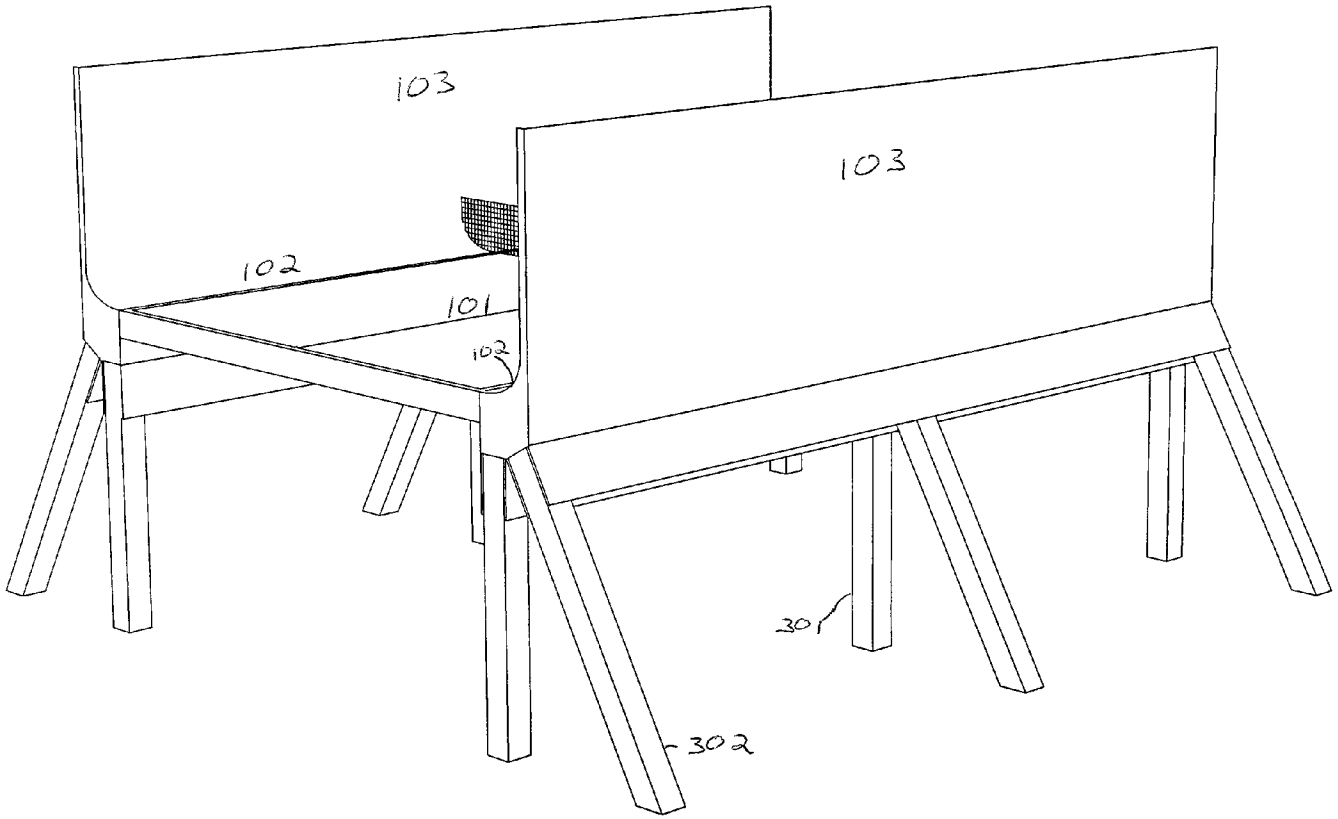
FIG. 11 shows a second perspective view of a table tennis apparatus with 90° curved sections of equal length to the horizontal section.
Figure 12:
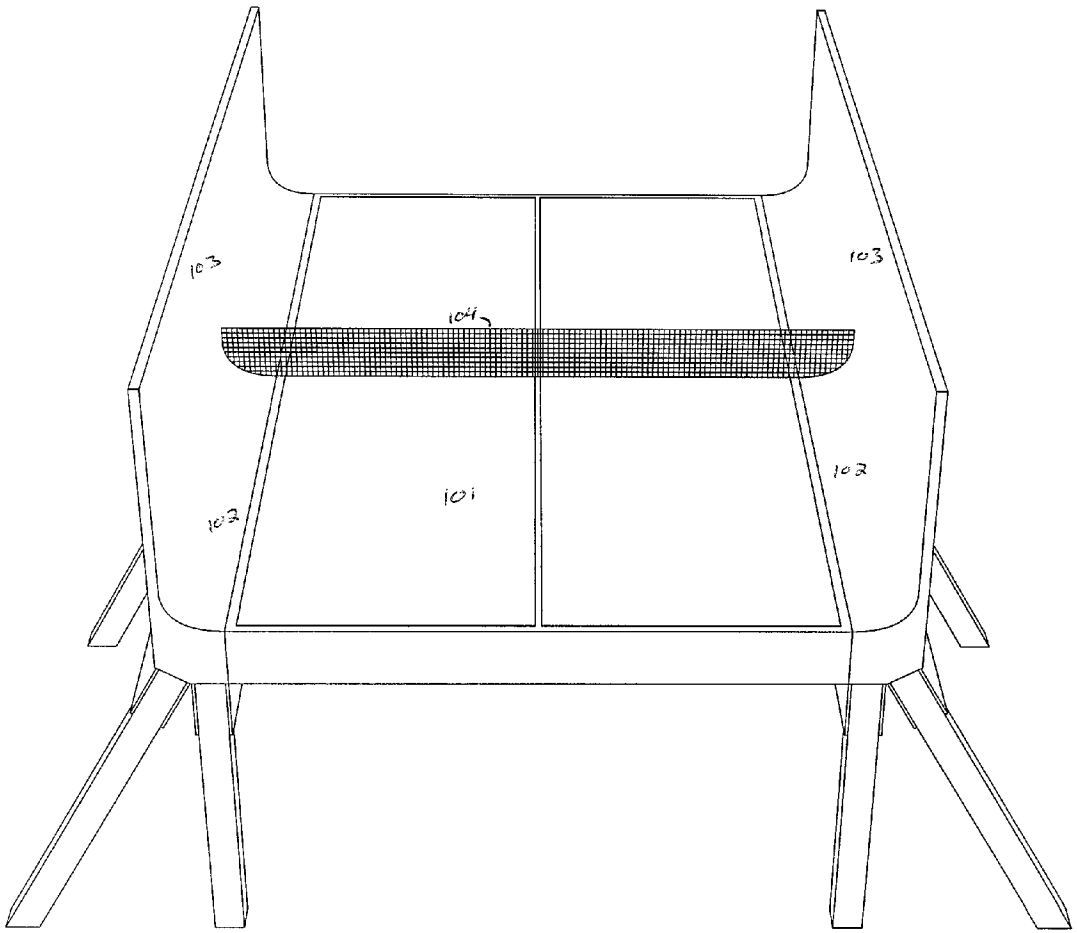
FIG. 12 shows a longitudinal view of a table tennis apparatus with 90° curved sections 102 of equal length to the horizontal section.
Figure 13:
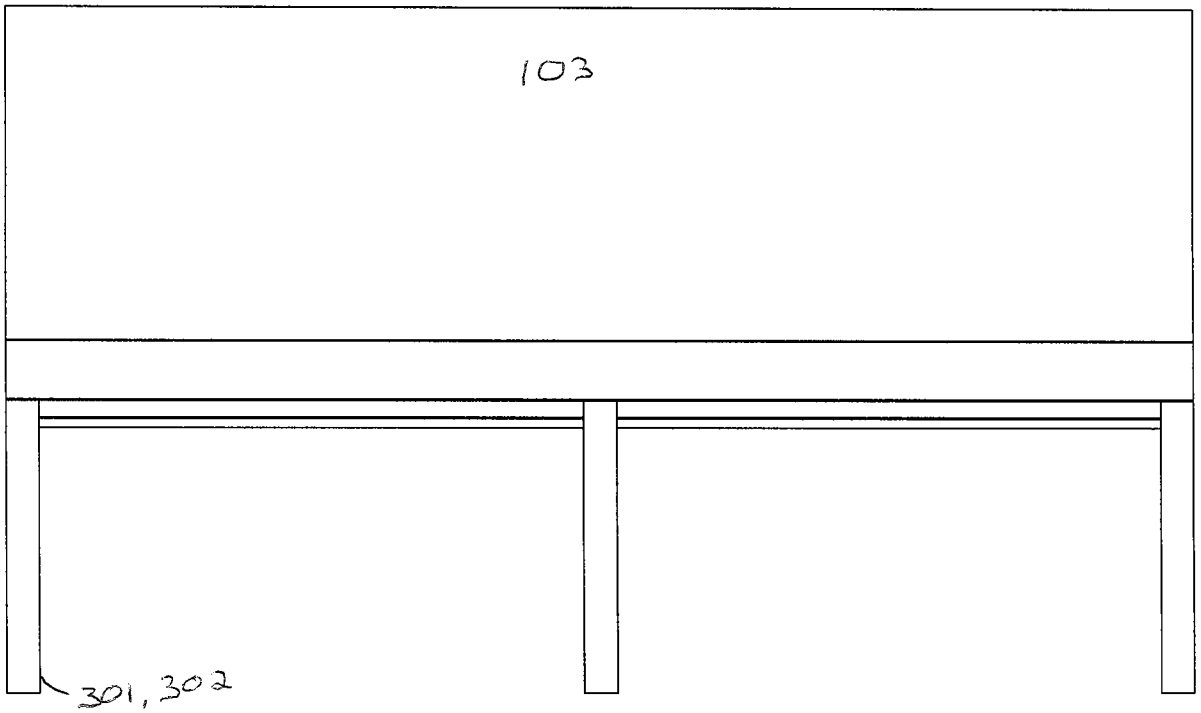
FIG. 13 shows a side view of a table tennis apparatus with 90° curved sections 102 of equal length to the horizontal section.
Figure 14:
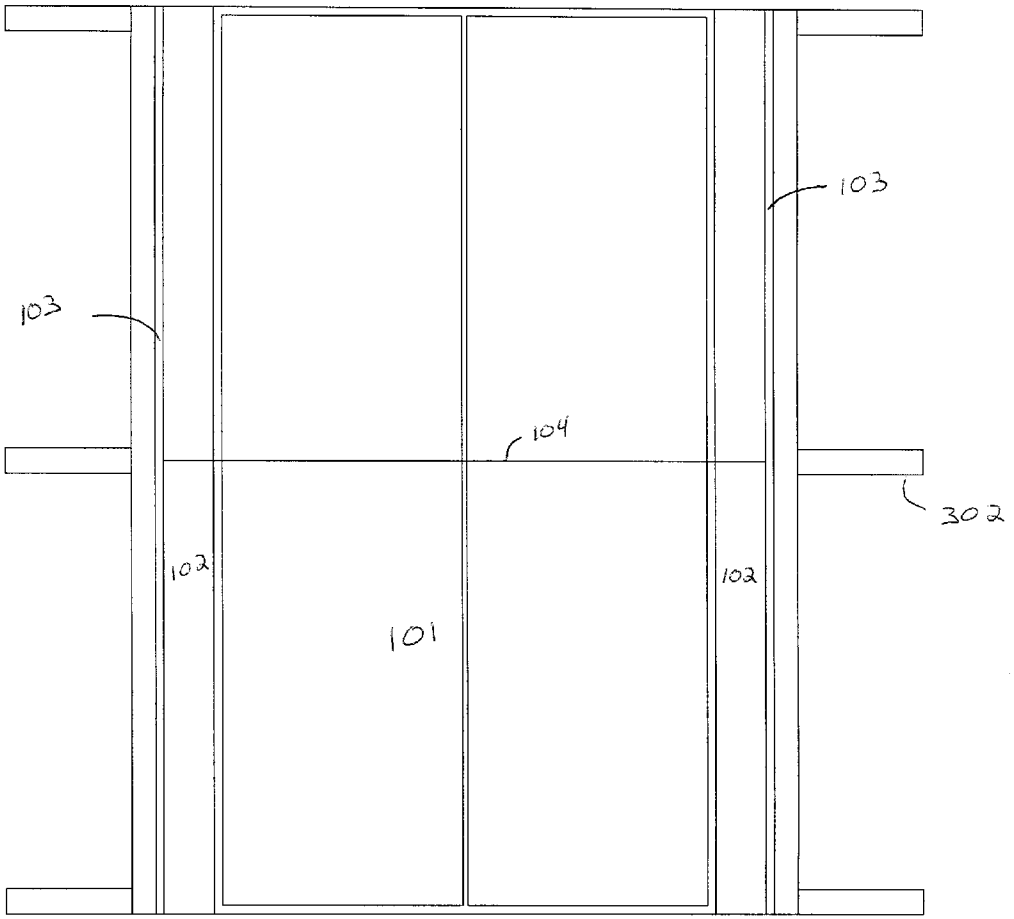
FIG. 14 shows a top view of a table tennis apparatus with 90° curved section of equal length to the horizontal section.
Figure 24:
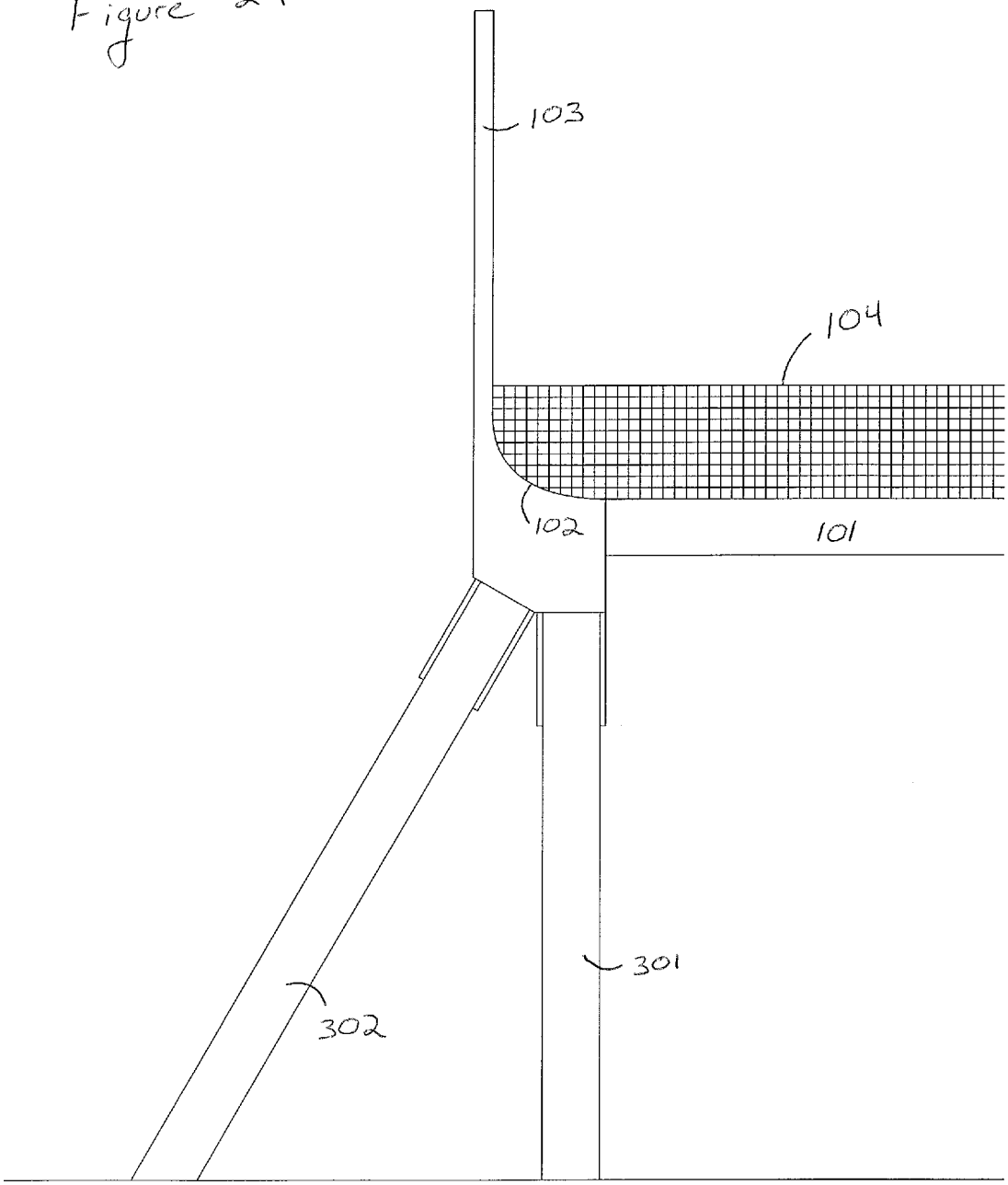
FIG. 24 is a longitudinal view of a curved section sidewall combination with legs structure.

FIGS. 9*a* and 9*b* are perspective views of a preferred embodiment of an extended playing surface apparatus configuration. In FIGS. 9*a* and 9*b* the playing surface of horizontal section 101 is extended by a total of 4 apparatuses each having a curved section 102, a sidewall 103, vertical supports 301 and angled supports 302. The four apparatuses are arranged symmetrically on each side of the horizontal section 101 and on each side of the net 104. Put in other words the four apparatuses would be mirror images of each other on each side of the horizontal section 101 and net 104. In this preferred embodiment, the texture and rebounding properties of the playing surfaces of horizontal section 101, curved sections 102 and sidewalls 103 are substantially uniform. The preferred dimensions of the horizontal section 101 are a width of 5 feet, length of 9 feet and a height of two feet and six inches from the ground (i.e. the standard for table tennis). The curved sections 102 would form together to have a combined length of 6 feet on each side of the horizontal section 101, the geometric description being an elliptical arc of 90° wherein radius "a" and "b" are six inches. The sidewall 103 is a combined six feet in length on each side of the horizontal section 101 and a width, or as drawn in FIGS. 9*a* and 9*b*, a vertical height of 2 feet. Accordingly, the combined height of the curved section 102 and sidewall section 103 from the horizontal section 101 is 2 feet and 6 inches. In this embodiment, the horizontal section 101 could be a standard table tennis table, and each extended playing surface apparatus would be attached at their respective symmetric locations. FIG. 24 is a close up longitudinal view of one of the combined table tennis extension apparatus comprising a curved section 102, vertical supports 301, combined horizontal and vertical supports or angled supports 302 and side wall 103 placed up against the side of horizontal section 101.

Although the combination of horizontal surface 101, curved section 102 and sidewall 103 have been discussed to create an extended table tennis playing surface, the extended table tennis apparatus alternatively could merely comprise a curved section 102 created and then provided to a normal table tennis playing surface. Depending on the radii "a" and "b" selected, an entirely curved section 102 without a flat sidewall section 103 could accomplish the goal of extending the table tennis playing surface. Radius "a" and "b" are not limited in size; however, in a preferred embodiment radius "a" and "b" are selected to be appropriate in size to the dimensions of a standard table tennis surface. In particular, radius "a" and "b" are selected to both equal 6 inches in a preferred embodiment. However, alternative embodiments can include radius "a">>radius "b" or radius "a"<<radius "b". For example, radius "a" may be chosen to equal 6 inches, yet radius "b" could be chosen to equal 36 inches. Then a desired degree range can be selected and a desired shape of the curved section 102 can be formed. One of ordinary skill in the art would recognize there are limitless combinations of radii and degree ranges to select in order to provide a curved section for the present invention.

It should be noted that mathematical description for obtaining the curved sections is for exemplary purposes for understanding the invention and planning the desired curve of the curved section. In practice the desired curve would be established and then efforts would be made to create the desired curved section with or without constructing an entire ellipsoid cylinder. There are numerous methods known of molding and shaping objects into curved surfaces. The present invention would preferably use materials for the curve that comprise rebounding properties similar to a table tennis playing surface i.e. masonite, wood, plywood, Plexiglas, glass, a one-way transparent material and even metal. Any material that possess the rebounding qualities desired and that can be shaped into the desired curved section may be used. The present invention is not limited to any one particular material. In a preferred embodiment, the curved section would be selected to be a transparent material having rebounding properties similar to a table tennis table. Plexiglas is an excellent candidate material for these effects and by selecting the desired thickness and type of Plexiglas, the desired transparency and desired rebounding properties can be achieved.

Like the curved sections 102, the sidewall extensions 103 can be of any material having desired transparency properties and rebounding properties. The concept of transparent curved and transparent side wall sections is to allow for the inclusion of individuals other than the two or more players facing each other on opposite ends of the playing surface to witness the ball movements and game-play without having to be along the parallel axis of the curved and side wall sections.

In an embodiment, the horizontal section, curved section, and side wall extension can all be made from one single piece of material and then molded to take the desired shape, mainly the curved section can be appropriately shaped as described above. In so doing, the need for external supports, that is, a support structure to hold up the curved section and sidewall section would not be needed. Standard table tennis table structures would simply hold up the table off the ground and the internal material would maintain it's shape naturally; for example, a single molded piece of Plexiglas would not need external supports to maintain the apparatus shape.

Figure 15:
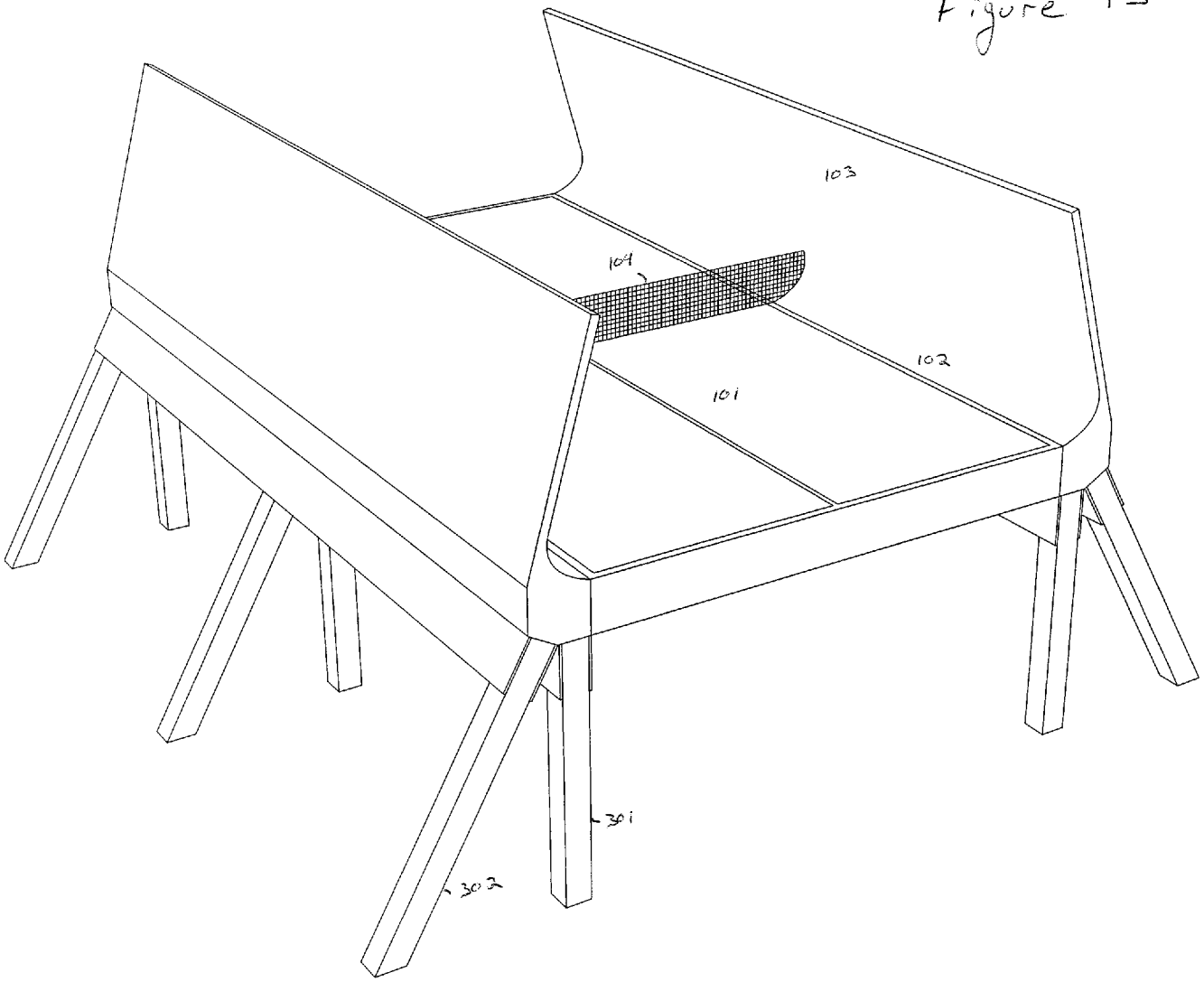
FIG. 15 shows a perspective view of a table tennis apparatus with greater than 90° curved sections 102 of equal length to the horizontal section.
Figure 16:
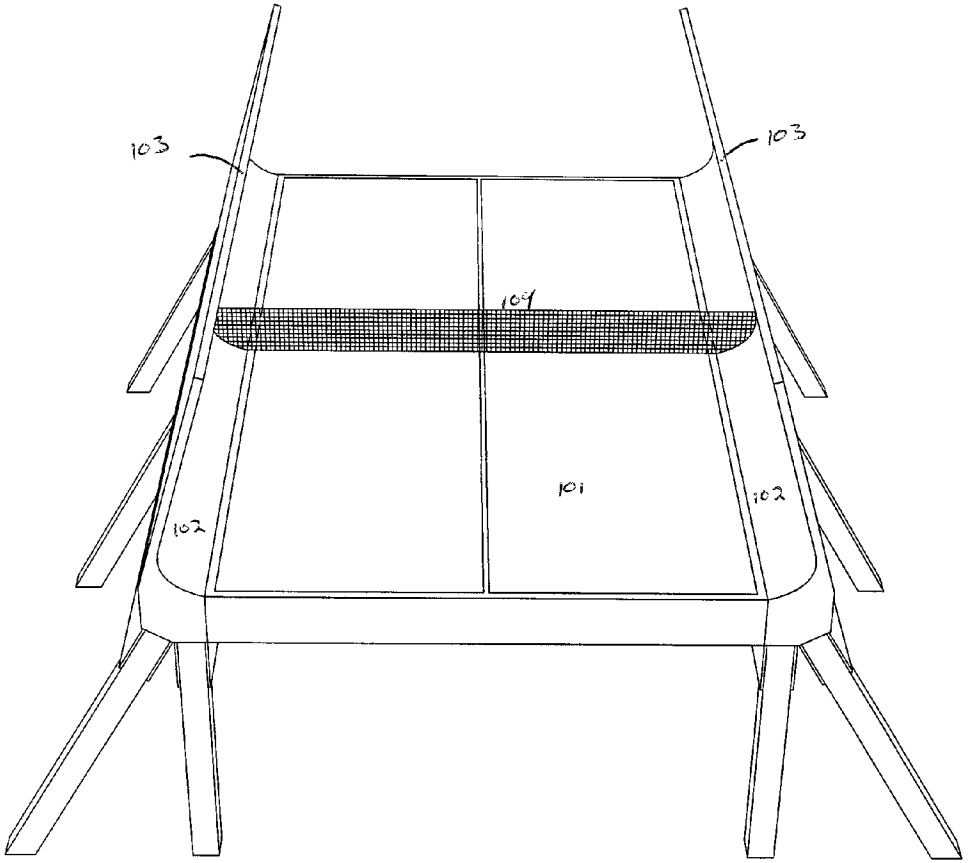
FIG. 16 shows a longitudinal view of a table tennis apparatus with greater than 90° curved sections 102 of equal length to the horizontal section.
Figure 17:
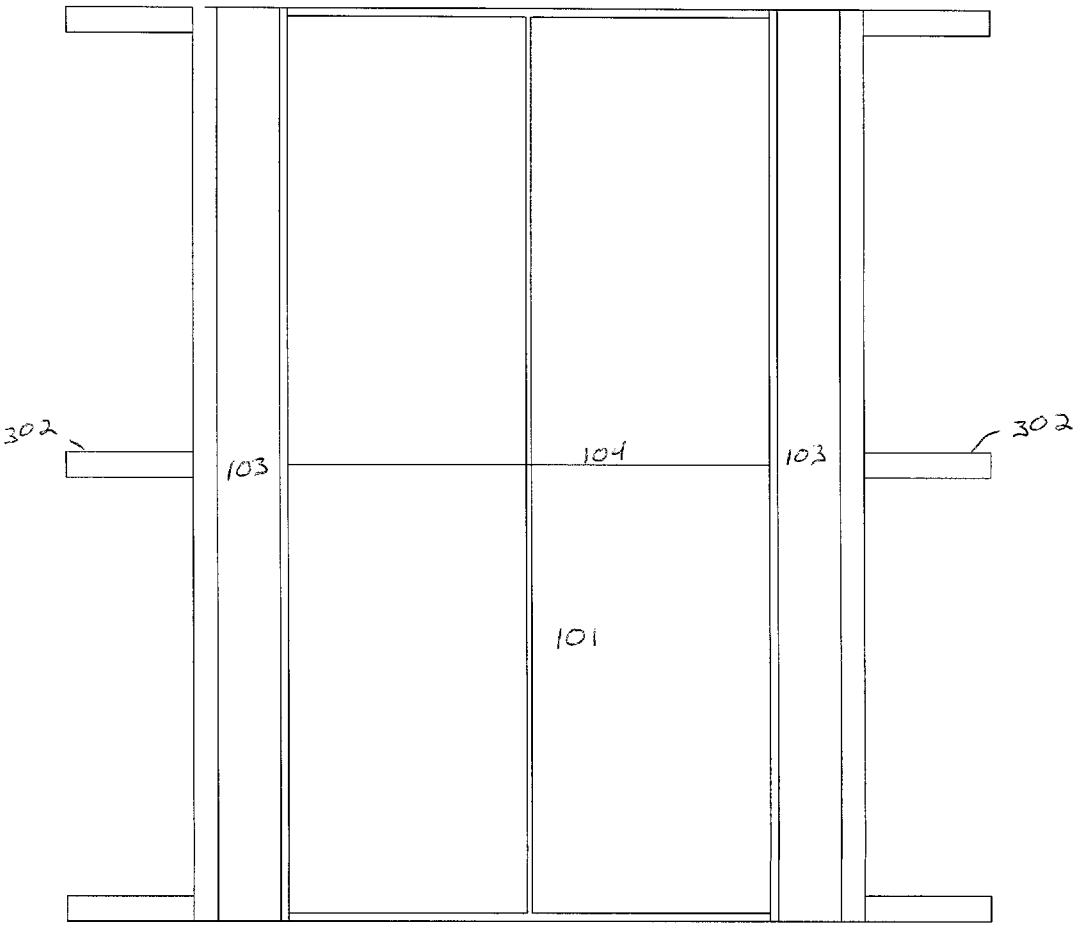
FIG. 17 shows a top view of a table tennis apparatus with greater than 90° curved sections 102 of equal length to the horizontal section.
Figure 18:
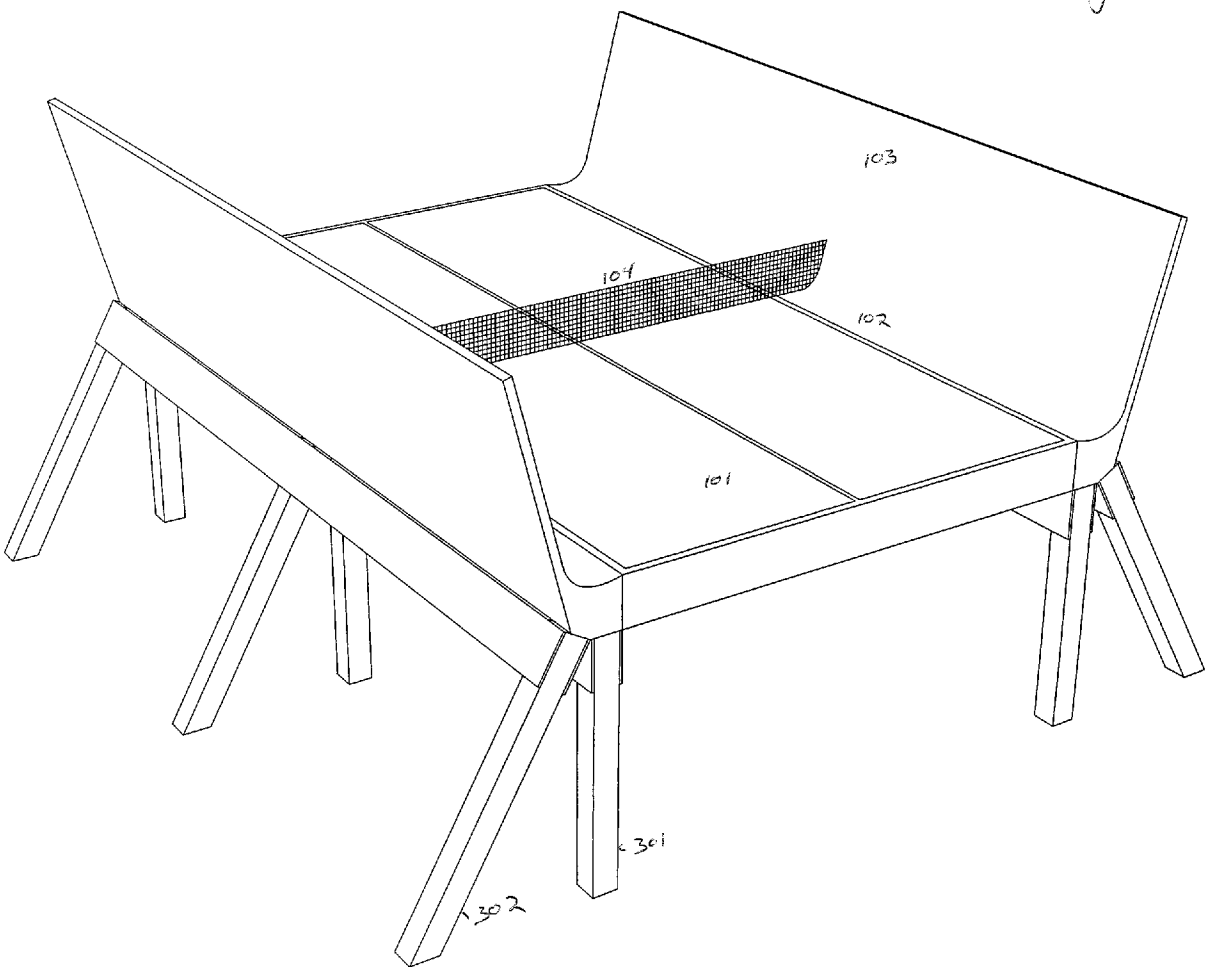
FIG. 18 shows a perspective view of a table tennis apparatus with less than 90° curved sections 102 of equal length to the horizontal section.
Figure 19:
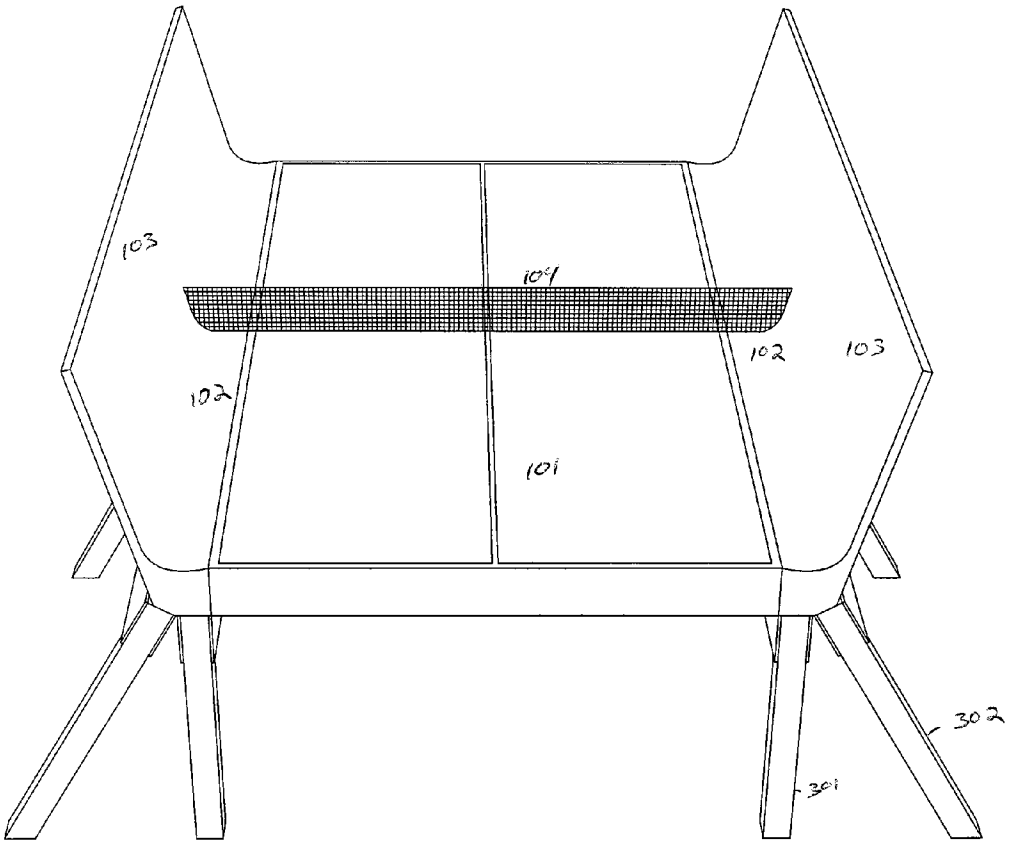
FIG. 19 shows a longitudinal view of a table tennis apparatus with less than 90° curved sections 102 of equal length to the horizontal section.
Figure 20:
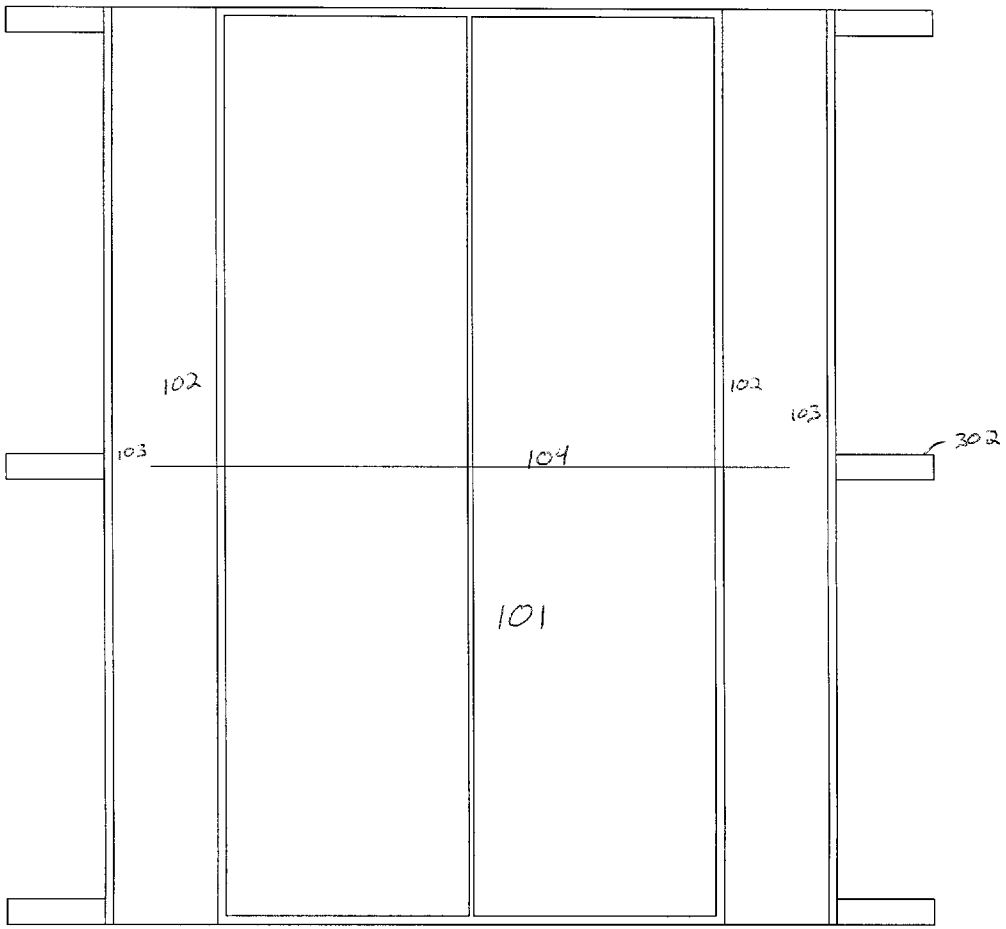
FIG. 20 shows a top view of a table tennis apparatus with less than 90° curved sections 102 of equal length to the horizontal section.
Figure 21:
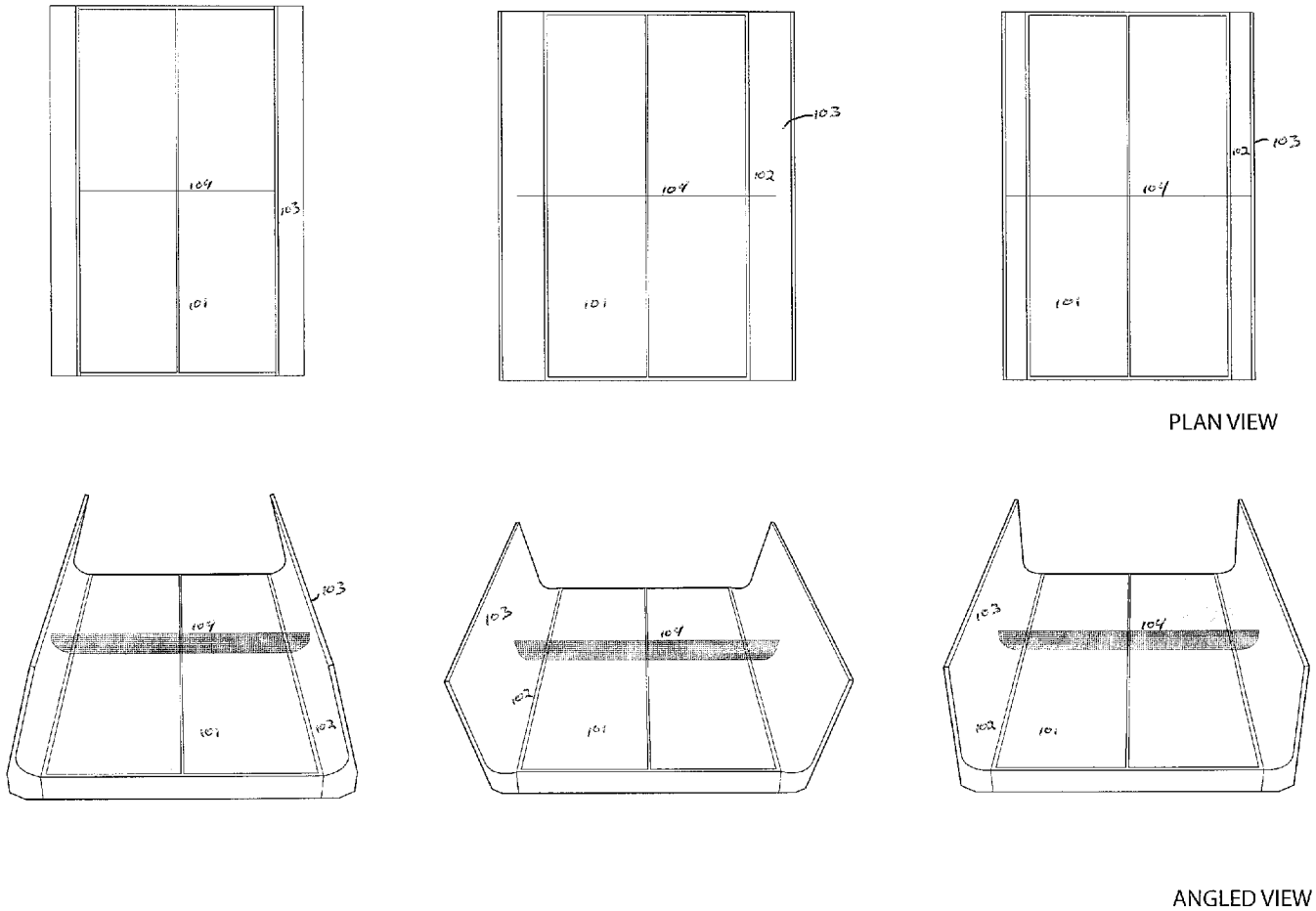
FIG. 21 is a composite of the longitudinal view and top view of the configurations of FIGS. 10-20.

Alternative embodiments of the extended table tennis apparatus may comprise a length of the curved sections 102 longer, the same or shorter than the horizontal section, and further comprise various radii combinations and various degree ranges selected. FIGS. 10-14 show exemplary images of a horizontal section 101 in combination with a curved section 102 and sidewall section 103, wherein the length of the curved section and sidewall sections have been selected to equal the length of the horizontal section. The curved section in FIGS. 10-14 has been formed by selecting radius "a"=radius "b" and the chosen angles to both equal 90°. FIGS. 15-17 show exemplary images of a horizontal section 101 in combination with a curved section 102 and sidewall section 103, wherein the length of the curved section and sidewall sections have been selected to equal the length of the horizontal section. The curved section in FIGS. 15-17 has been formed by selected radius "a"=radius "b" and the chosen angles to both be greater than 90°. FIGS. 18-20 show exemplary images of a horizontal section 101 in combination with a curved section 102 and sidewall section 103, wherein the length of the curved section and sidewall sections have been selected to equal the length of the horizontal section. The curved section in FIGS. 18-20 has been formed by selected radius "a"=radius "b" and the chosen angles to both be less than 90°. FIG. 21 is a composite of the longitudinal view and top view of the configurations of FIGS. 10-20.

Figure 22:
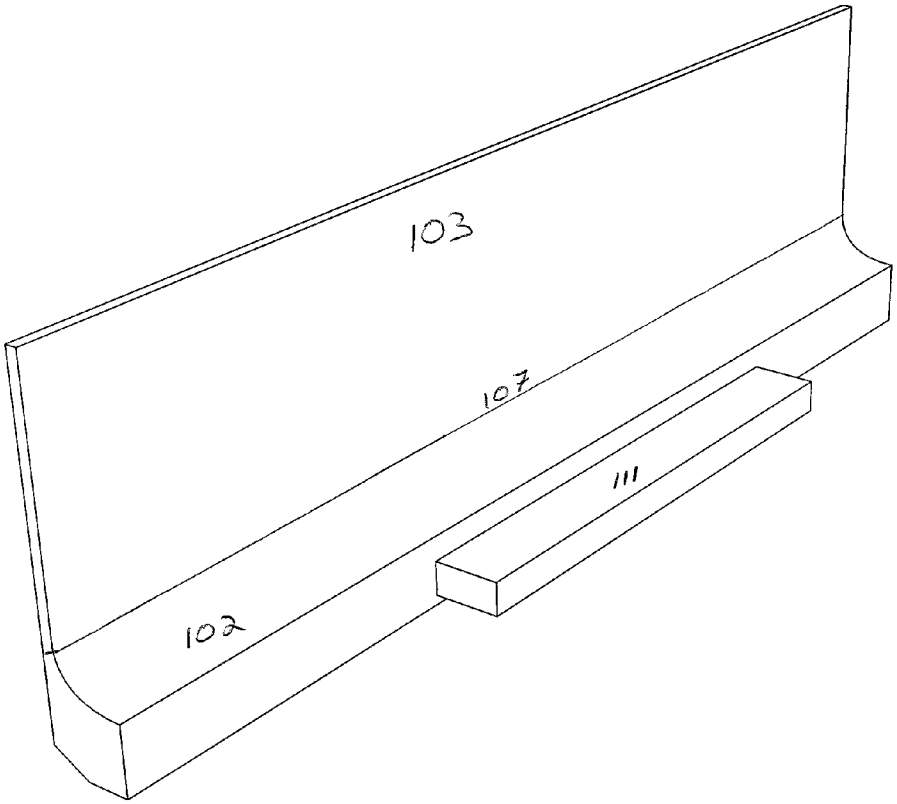
FIG. 22 shows a combined curved section and sidewall attachment apparatus for extending a table tennis playing surface.
Figure 23:
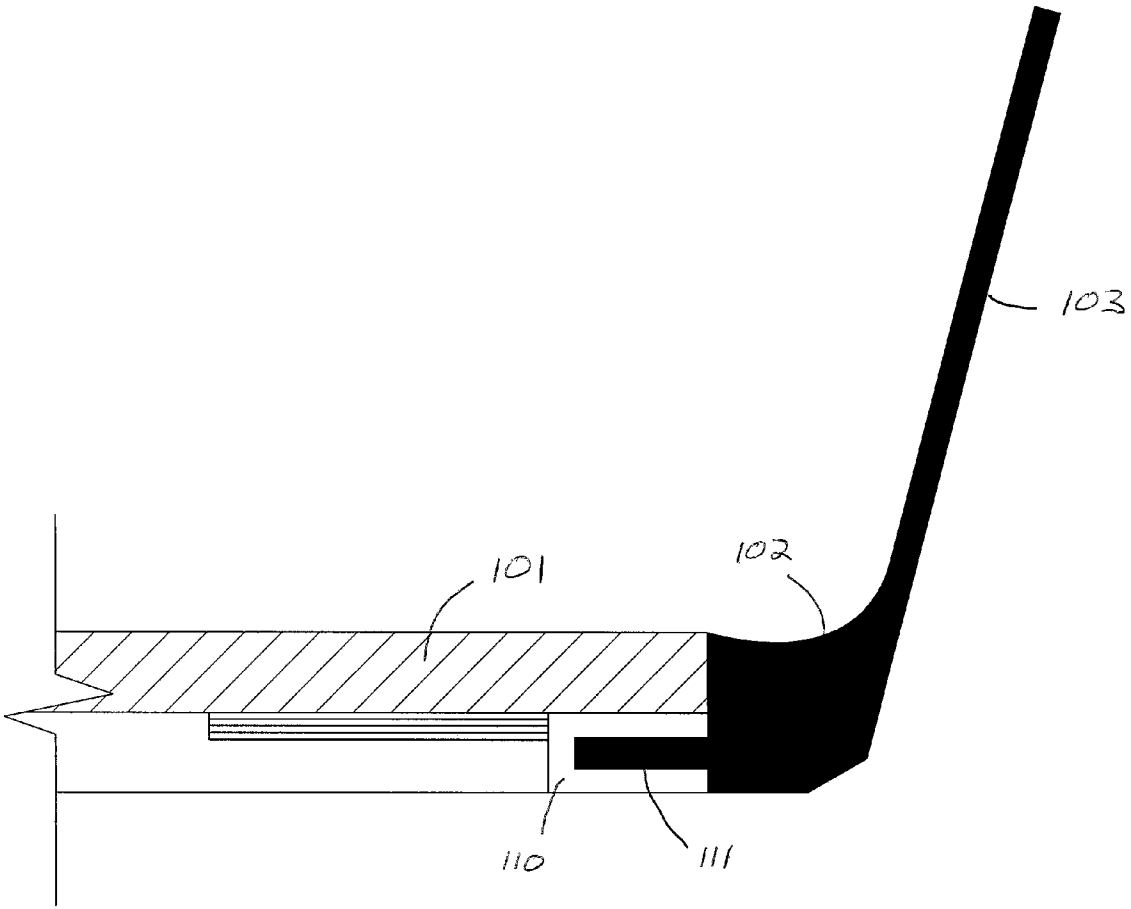
FIG. 23 shows a longitudinal view of a male-female curved section sidewall attachment configuration.

In embodiments where the curved section 102 is not made from a single piece of material in connection with the horizontal section 101, the curved section 102 can be held to the horizontal section 101 through numerous means, such as an adhesive. Alternatively, a molded structure could be present on both the horizontal section 101 and the curved section 102 configured to interlock. Alternatively, a vice type device designed to run underneath the horizontal section 101 and apply pressure to opposing curved sections 102 thereby holding the curved sections 102 in place could be used. Alternatively, the support structure itself with vertical supports 301 and angled supports 302 holding up the curved section could be used to hold the curved section 102 in place against the horizontal section 101. If wheels are provided on the ends of vertical supports 301 and/or angled supports 302, the wheels could be locked in place. Alternatively, FIG. 22 shows an exemplary extending playing surface apparatus comprising a curved section 102, a sidewall extension 103 and a male component 111. In this embodiment, as shown in FIG. 23, a female component 110 can be attached to the lower side of horizontal section 101, which can receive and secure the male component 111 of the combined apparatus of curved section 102 and sidewall 103.

In the above embodiments, to further enhance table tennis gameplay, light emitting objects can be adhered to or implanted in the table tennis playing apparatus of the present disclosure, especially when the material chosen is transparent in nature. Glow in the dark tape can be adhered as the lines on the table tennis playing surface, curved section, and side wall extensions to mark the boundary of the playing region regardless if the material chosen is transparent or opaque. In addition, the boundaries can be marked by paint or some other form of contrast/color. In the case where the apparatus is made from a transparent material, LEDs or other light emitting objects can be implanted into or adhered to the material.

Although the primary object of the present invention is to provide an apparatus for extending the playing surface for the game of table tennis; applications of the enclosed invention may expand to other racket based games, such as but not limited to, racketball, tennis, etc. Various other designs and adaptations can be accomplished without limitations by the disclosure herein. Although examples and exemplary embodiments of the invention have been disclosed for illustrative purposes, those skilled in the art will appreciate that various modifications, additions and substitutions are possible, without departing from the scope and spirit of the disclosure and the accompanying claims. For example, elements and/or features of different examples and illustrative embodiments may be combined with each other and/or substituted for each other within the scope of this disclosure and appended claims.

What is claimed is:

1. A table tennis apparatus for extending a table tennis playing surface comprising:

a rigid rebounding concave curved section having a predetermined length;

a central axis;

a first edge and a second edge both perpendicular to said central axis;

a third edge and a fourth edge equal to said predetermined length, and both parallel to said central axis;

a first surface on the interior of said concave curved section;

a second surface on the exterior of said concave curved section;

wherein said third edge is configured to attach to a side edge of said table tennis playing surface; and wherein said first surface is configured to extend said table tennis playing surface; and a support structure configured to elevate said concave curved section to a height of said table tennis playing surface, wherein said curved section is substantially the shape of an arc equal to an elliptical arc formed from a section of an ellipse having a pre-determined first radius and a pre-determined second radius, wherein an angle formed by the start of said elliptical arc, an origin of said ellipse and an end of said elliptical arc equals an angle formed by said third edge, said central axis and said fourth edge, wherein when said third edge is attached to a side edge of said table tennis playing surface, the first surface of the rigid rebounding concave curved section is vertically above the height of the table tennis playing surface.

2. The table tennis apparatus of claim 1, further comprising a rebounding sidewall comprising:

a joining edge configured to attach to said fourth edge of said curved section;

a rebounding surface, configured to extend said first surface of said curved section; and an exterior surface configured to extend said second surface of said curved section.

3. The table tennis apparatus of claim 2, wherein said concave curved section and rebounding side wall are formed from the same piece of material thereby forming one continuous section, wherein said third edge of said concave curved section and said joining edge of said rebounding side wall are a continuous union.

4. The table tennis apparatus of claim 2, wherein a material used to form said sidewall is transparent, translucent or opaque.

5. The table tennis apparatus of claim 2, wherein light emitting objects are implanted in or adhered to said sidewall.

6. The table tennis apparatus of claim 1, wherein a material used to form said curved section is transparent, translucent or opaque.

7. The table tennis apparatus of claim 1, wherein light emitting objects are implanted in or adhered to said apparatus.

8. A method for extending a table tennis playing surface comprising the steps of:

forming a rigid rebounding concave curved playing surface section comprising:

a predetermined length, a predetermined thickness, a central axis, a first edge and a second edge both perpendicular to said central axis, a third edge and a fourth edge equal to said predetermined length and both parallel to said central axis, a first surface on the interior of said concave curved section, a second surface on the exterior of said concave curved section, said third edge being configured to attach to a side edge of said standard table tennis playing surface, and said first surface being configured to extend said table tennis playing surface;

attaching said curved playing surface section to a side of a table tennis playing surface.

9. The method of claim 8, further comprising:

attaching a rebounding side wall to the fourth edge of said curved playing surface, said side wall comprising:

an edge configured to attach to said fourth edge of said curved section, a rebounding surface configured to extend said first surface of said curved section, and an exterior surface configured to extend said second surface of said curved section.

10. A table tennis playing surface apparatus comprising:

a horizontal section comprising:

a first playing surface, a first and a second side edge equal to a length of the horizontal section, and a front edge and a back edge equal to a width of the horizontal section;

one or more rigid rebounding concave curved playing surface sections each comprising:

a second playing surface on an interior of the concave curved section, a first and second side edge equal to a length of said curved section, a front edge and back edge, wherein said curved section is connected at either the first or second side edge of the curved section to the first or second side edge of said horizontal playing surface thereby combining said first and second playing surfaces; and one or more planar playing surface sections each comprising:

a third playing surface comprising a first and a second side edge equal to the length of said curved section, a front and a back edge, wherein each planar playing surface section extends from an unconnected side edge of each curved playing surface.

11. The table tennis playing surface of claim 10, wherein said curved section is shaped as a section of an ellipse of radius "a" and radius "b".

12. The table tennis playing surface of claim 10, wherein one or more of the horizontal section, the curved section and the planar section are transparent, translucent or opaque.

13. The table tennis playing surface of claim 10 wherein the rebounding properties of said horizontal playing surface, curved playing surface and planar playing surface extension are substantially the same.

14. The table tennis playing surface of claim 10, wherein the length of the curved section is selected to be less than or equal to the length of the horizontal playing surface.

15. The table tennis playing surface of claim 10, wherein the horizontal playing surface, curved playing surface and planar playing surface extension form a continuous smooth playing surface.

16. The table tennis playing surface of claim 10, wherein the rebounding properties of said horizontal playing surface, curved playing surface and planar playing surface extension are different.

17. The table tennis playing surface of claim 10, wherein said curved section comprises a slit of sufficient size through which a table tennis net can be positioned.

18. The table tennis playing surface of claim 10, wherein said planar playing surface extension comprises a slit configured to extend said slit in the curved section.

* * * * *